US009115891B2

(12) United States Patent
Akiyama et al.

(10) Patent No.: US 9,115,891 B2
(45) **Date of Patent: *Aug. 25, 2015**

(54) RICH-LEAN COMBUSTION BURNER

(75) Inventors: Takashi Akiyama, Hyogo (JP); Norihide Wada, Hyogo (JP); Takeshi Wakada, Hyogo (JP); Yasutaka Kuriyama, Hyogo (JP); Ryosuke Umakoshi, Hyogo (JP); Itsuo Nagai, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 847 days.

This patent is subject to a terminal disclaimer.

(21) Appl. No.: 13/328,673

(22) Filed: Dec. 16, 2011

(65) Prior Publication Data

US 2012/0156629 A1 Jun. 21, 2012

(30) Foreign Application Priority Data

Dec. 16, 2010 (JP) ..... 2010-280650
Apr. 25, 2011 (JP) ..... 2011-097044

(51) Int. Cl.
*F23D 14/46* (2006.01)
*F23D 14/58* (2006.01)
*F23D 14/04* (2006.01)
*F23D 14/62* (2006.01)

(52) U.S. Cl.
CPC ..... *F23D 14/586* (2013.01); *F23D 14/04* (2013.01); *F23D 14/62* (2013.01); *F23C 2201/20* (2013.01); *F23D 2900/00003* (2013.01)

(58) Field of Classification Search
USPC ..... 137/833, 561 A, 802; 239/533.2, 565, 239/590
See application file for complete search history.

(56) References Cited

U.S. PATENT DOCUMENTS

| | | | | | |
|---|---|---|---|---|---|
| 2,470,880 | A | * | 5/1949 | Zimbelman et al. | 239/556 |
| 2,525,960 | A | * | 10/1950 | Shaw | 239/423 |
| 2,541,710 | A | * | 2/1951 | Miller | 239/427.3 |
| 2,572,273 | A | * | 10/1951 | Miller et al. | 239/553.3 |
| D165,883 | S | * | 2/1952 | Solomon et al. | D23/415 |
| 2,746,799 | A | * | 5/1956 | Lewen | 239/279 |
| 2,828,532 | A | * | 4/1958 | Taylor | 29/890.02 |
| 2,940,517 | A | * | 6/1960 | Skellern | 239/289 |
| 3,215,186 | A | * | 11/1965 | Levitt | 431/126 |

(Continued)

FOREIGN PATENT DOCUMENTS

| | | | |
|---|---|---|---|
| JP | 07-042917 | A | 2/1995 |
| JP | 11-051328 | A | 2/1999 |

(Continued)

*Primary Examiner* — Gregory Huson
*Assistant Examiner* — Martha Becton
(74) *Attorney, Agent, or Firm* — Fishman Stewart Yamaguchi PLLC

(57) ABSTRACT

A row of rich-side flame holes is centrally arranged. Two rows of lean-side flame holes are arranged on both sides of the rich-side flame hole row, respectively. In addition, two rows of rich-side flame holes are arranged on the outsides of the two lean-side flame hole rows, respectively. A lower end part of a central rich-side burner part is projected into a tubular part into which the rich-side mixture is introduced, and communication holes in fluid communication with an inner space are formed in walls on both sides so as to pass completely therethrough in alignment with each other. Each communication hole has a larger diameter than an inner width P and is disposed at a potion situated nearer to the upper of the tubular part and nearer to the front so as to leave, at the rear, a space in which dust p particles are accumulated.

9 Claims, 19 Drawing Sheets

(56) References Cited

U.S. PATENT DOCUMENTS

| | | | | | |
|---|---|---|---|---|---|
| 3,512,910 | A * | 5/1970 | Hein | 431/154 |
| 3,526,367 | A * | 9/1970 | Trihey | 239/556 |
| 3,615,249 | A * | 10/1971 | Martois | 422/183 |
| 3,708,126 | A * | 1/1973 | De Kinkelder | 239/590.5 |
| 4,185,780 | A * | 1/1980 | Duchene et al. | 239/553.5 |
| 4,222,526 | A * | 9/1980 | Halstead | 239/556 |
| 4,417,868 | A * | 11/1983 | Putnam | 431/1 |
| 4,940,406 | A * | 7/1990 | Kee | 431/22 |
| 5,062,788 | A * | 11/1991 | Best | 431/7 |
| 5,073,106 | A * | 12/1991 | Toyonaga et al. | 431/285 |
| 5,099,879 | A * | 3/1992 | Baird | 137/561 A |
| 5,318,438 | A * | 6/1994 | Sugahara et al. | 431/285 |
| 5,368,476 | A * | 11/1994 | Sugahara et al. | 431/285 |
| 5,525,054 | A * | 6/1996 | Nakaura et al. | 431/285 |
| 5,833,449 | A * | 11/1998 | Knight et al. | 431/191 |
| 6,000,934 | A * | 12/1999 | Shavers et al. | 431/354 |
| 6,746,236 | B2 * | 6/2004 | Kuriyama et al. | 431/354 |
| 6,786,717 | B2 * | 9/2004 | Shimazu et al. | 431/354 |
| 6,960,077 | B2 * | 11/2005 | Buccilli et al. | 431/354 |
| 7,137,568 | B1 * | 11/2006 | LaCrosse | 239/1 |
| D672,869 | S * | 12/2012 | Akiyama et al. | D23/415 |
| D681,801 | S * | 5/2013 | Akiyama et al. | D23/415 |
| 2012/0219920 | A1 * | 8/2012 | Akiyama et al. | 431/278 |
| 2013/0149653 | A1 * | 6/2013 | Fukunishi et al. | 431/278 |
| 2013/0171576 | A1 * | 7/2013 | Akiyama et al. | 431/354 |
| 2013/0247844 | A1 * | 9/2013 | Cheng et al. | 122/18.4 |

FOREIGN PATENT DOCUMENTS

| | | | |
|---|---|---|---|
| JP | 2002-038314 | A | 2/2002 |
| JP | 2002-048312 | A | 2/2002 |
| JP | 2002-115817 | A | 4/2002 |
| JP | 2003-269705 | A | 9/2003 |
| JP | 2003-269707 | A | 9/2003 |
| JP | 2007-285536 | A | 11/2007 |

* cited by examiner (a)

(b)

(a)

(b)

(c)

RICH-LEAN COMBUSTION BURNER

TECHNICAL FIELD

The present invention relates to a rich-lean combustion burner which is provided, in order to achieve NOx reduction while ensuring steady flame combustion, with rich-side flame holes and lean-side flame holes. In particular, the present invention is directed to technology for improving the stability of combustion to a further extent by enhancing, even when the width of rich-side flame holes is set thin, the performance of resistance to linting (i.e., the performance capable of avoiding the occurrence of rich-side mixture supply failure associated with the adhesion of dust particles or other like particles) in a rich-side mixture which is supplied to the rich-side flame holes and in a supply channel thereof.

BACKGROUND ART

Heretofore, there have been proposed various types of rich-lean combustion burners (for example, see Patent Literature Publications 1, 2 and 3). In such a rich-lean combustion burner, a lean-side mixture whose air ratio (the ratio of the amount of air to the amount of fuel) is in excess of 1.0 is burned at lean-side flame holes for the accomplishment of NOx reduction while for the stabilization of combustion flames, rich-side flame holes where a rich-side mixture whose air ratio falls below 1.0 is burned are arranged adjacent to the lean-side flame holes.

CITATION LIST

Patent Literature

Patent Literature Publication 1: JP-A-H07-42917
Patent Literature Publication 2: JP-A-2002-48314
Patent Literature Publication 3: JP-A-2007-285536

SUMMARY OF INVENTION

Technical Problem

Incidentally, Patent Literature Publications 1 and 2 employ the following means as a method for separately supplying a rich-side mixture and a lean-side mixture in such a way that the rich-side flame holes are fed with a premixed rich-side mixture whereas the lean-side flame holes are fed with a premixed lean-side mixture. That is, according to Patent Literature Publication 1, there are separately provided a rich-side mixture supply port and a lean-side mixture supply port so that the rich-side mixture is directly supplied to the rich-side flame holes from the rich-side mixture supply port while on the other hand the lean-side mixture is directly supplied to the lean-side flame holes from the lean-side mixture supply port. In addition, according to Patent Literature Publication 2, there are separately provided a supply port for fuel gas and a supply port for air, and by diverging supply channels extending respectively to the rich-side flame holes and to the lean-side flame holes or by varying the length of the supply channels, the level of richness/leanness of the mixtures is controlled.

The use of such a supply method makes it possible to supply a rich-side mixture and a lean-side mixture even to a rich-lean combustion burner of the type proposed in Patent Literature Publication 3, i.e., a rich-lean combustion burner in which rich-side flame holes are arranged on either side of a row of lean-side flame holes (that is, the lean-side flame hole row is merely sandwiched, from both sides, between the rich-side flame hole rows). However, if a row of rich-side flame holes is added so as to extend in the direction of the central line of the lean-side flame holes whereby to provide such a configuration that the rich-side flame holes and the lean-side flame holes are alternately arranged in order of RICH-LEAN-RICH-LEAN-RICH in the widthwise direction (i.e., in the direction of the horizontal width), this results in complication in the structure of supply channels for the supply of rich-side and lean-side mixtures to the rich-side flame holes and to the lean-side flame holes, therefore causing conditions against the saving of weight.

Furthermore, when supplying a rich-side mixture and a lean-side mixture, respectively, to the rich-side flame holes and to the lean-side flame holes, there may be the case in which the supply of the rich-side mixture to the centrally situated rich-side flame holes becomes problematic. That is, since the centrally situated rich-side flame holes are those that are to be newly added, they are not allowed to spread too much in their width in the widthwise direction because of the requirement to make the entire burner size compact, and therefore have to be made narrow as a rich-side mixture supply channel. As a result, dust particles contained in the air to be mixed with fuel for generating a rich-side mixture will partially adhere to the rich-side mixture supply channel depending on the flow state of the rich-side mixture and the possibility of inhibition against the supply of the rich-side mixture may be conceivable.

For example, as shown in an example of FIG. 19, a supply channel 101, a supply channel 102 and a supply channel 103, which are in fluid communication with their respective rich-side flame holes situated at three different positions (the central position, the left-hand side position and the right-hand side position), are diverged from a mixing chamber 100 for the supply of rich-side mixture, whereby each of the rich-side flame holes situated at the three positions is fed with the rich-side mixture. In such a case, there is a conceivable possibility that especially when the rich-side mixture, which is flowing in from a communication hole 104 through which the rich-side mixture is supplied to the supply channel 101 in fluid communication with the centrally situated rich-side flame holes, collides against a facing wall 105 serving as a wall surface constituting the rich-side flame hole supply channel 101 and situated face to face with the communication hole 104, dust particles as described above adhere and accumulate, thereby narrowing the channel cross section of the supply channel 101. To sum up, there occurs linting (adhesion of dust particles) that impedes the flowing-in of the rich-side mixture and due to this, it becomes likely to cause ignition failure and to make the state of combustion unstable.

With the circumstances as described above in mind, the present invention was developed. Accordingly, an object of the present invention is to enable lean-side and rich-side mixtures to be certainly supplied, respectively, to lean-side and rich-side flame holes combined in multiple way by a simple structure, and to improve the performance of resistance to linting by preventing the occurrence of adhesion and accumulation of dust particles likely of being contained in the air constituting the rich-side mixture when supplied to the rich-side flame holes through communication holes, thereby providing a rich-lean combustion burner capable of accomplishing improvement in the stability of combustion.

Solution to Problem

In order to accomplish the foregoing object, the present invention has the following specific particulars intended for a rich-lean combustion burner in which two rows of lean-side flame holes are disposed so as to sandwich, therebetween and from both lateral sides, one row of central rich-side flame holes disposed so as to longitudinally extend in a central position and two rows of outer rich-side flame holes are disposed so as to sandwich, therebetween and from outside, both the two lean-side flame hole row. That is, it is arranged that the flow of a rich-side mixture introduced into a single rich-side mixture introduction channel is diverged from the single rich-side mixture introduction channel, whereby the rich-side mixture is distributed to the one central rich-side flame hole row and to the two outer rich-side flame hole rows. A first supply channel for supply of the rich-side mixture to the central rich-side flame hole row, a second and a third supply channel for individual supply of the rich-side mixture to each of the two outer rich-side flame hole rows and the rich-side mixture introduction channel are partitioned from one another. A portion of a formation member for partition formation of the first supply channel is disposed so as to project into the rich-side mixture introduction channel, and a first communication hole in fluid communication with the first supply channel is formed in the projecting portion of the formation member so as to open facing towards the inside of the rich-side mixture introduction channel, while on the other hand a second communication hole in fluid communication with the second supply channel and a third communication hole in fluid communication with the third supply channel are formed in a formation member for partition formation of the rich-side mixture introduction channel so that each of the second and the third communication holes opens facing towards the inside of the rich-side mixture introduction channel at a respective position corresponding to the position of the first communication hole in the projecting portion.

The present invention makes it possible that in a rich-lean combustion burner in which rich-side flame holes and lean-side flame holes are arranged in order of RICH-LEAN-RICH-LEAN-RICH, the flow of a rich-side mixture introduced from a single rich-side mixture introduction channel is diverged for individual supply of the rich-side mixture to a row of central rich-side flame holes through a first communication hole of a projecting portion projecting into the rich-side mixture introduction channel and to a pair of rows of outer rich-side flame holes through a second and a third communication hole formed in a formation member for partition formation of the rich-side mixture introduction channel. Accordingly, even in such a type of burner with an array order of RICH-LEAN-RICH-LEAN-RICH, the rich-side mixture is smoothly and certainly diverged for supplying to each of the rich-side flame holes by a simple structure. In addition, it becomes possible to easily provide the supply of rich-side mixture to each rich-side flame hole at the same flow rate, at the same flow velocity or at the same pressure by the setting of the opening area of the first, the second and the third communication holes or by other like adjustment, thereby making it possible to certainly provide the supply of rich-side mixture at the same air ratio.

Furthermore, it is possible that the rich-side mixture introduction channel longitudinally extends, with its downstream end closed, that the first supply channel is partition-formed between one pair of walls situated facing each other in lateral direction in the projecting portion of the formation member, with a predetermined inner width spaced therebetween, and that the first communication hole in fluid communication with the first supply channel is formed in each of the wall pair and both the first communication holes are formed so as to pass through in alignment with each other in lateral direction.

Because of this arrangement, both the first communication holes formed in the wall pair pass therethrough in alignment with each other in the lateral direction, thereby being placed in a state of being in fluid communication with the rich-side mixture introduction channel without any obstruction relative to the lateral direction. This enables the rich-side mixture flowing towards the first supply channel via each first communication hole from the rich-side mixture supply channel to smoothly flow towards and into the first supply channel without collision against obstacles such as wall surfaces. Therefore, it becomes possible to prevent the possibility of adhesion and accumulation of dust particles likely of being contained in the air forming the rich-side mixture due to collision against obstacles such as wall surfaces. In consequence of the above, the resistance to linting is improved, thereby enhancing the stability of combustion.

It may be arranged in such a way that each of the first communication holes formed in the wall pair is formed so as to have an opening the size of which is equal to or in excess of the inner width between the wall pair at a location where each of the first communication holes is formed. This arrangement makes it possible to more certainly avoid the occurrence of adhesion and accumulation of dust particles. That is, since not only both the first communication holes are just in alignment with each other but also they have a large opening, this makes it possible to prevent the entire flow of inflowing rich-side mixture from collision against obstacles such as wall surfaces.

In addition, it may be arranged in such a way that each of the first communication holes formed in the wall pair is formed at the projecting portion on a position situated nearer to the upstream of the rich-side mixture introduction channel so as to leave an inner space on the side nearer to the closed end of the rich-side mixture introduction channel than the first communication hole formation location. As a result of such arrangement, even in the case where dust particles are contained in the rich-side mixture present in the rich-side mixture introduction channel, the dust particles are held in the inner space downstream of each first communication hole, thereby making it possible to prevent their entrance to the first supply channel from each first communication hole.

Furthermore, it may be arranged in such a way that each of the first communication holes formed in the wall pair is formed at a upper part of the projecting portion in the rich-side mixture introduction channel. As a result of such arrangement, the first communication holes correspond to the flow of rich-side mixture flowing through the rich-side mixture introduction channel, thereby enabling the rich-side mixture to smoothly flow into the first communication holes. To sum up, as the rich-side mixture, introduced into the rich-side mixture introduction channel and then flowing downstream, advances in the downstream direction, the flow thereof changes direction to now travel slightly obliquely upward and, therefore, easily enters the first communication holes. In addition, even in the case where dust particles, which have entered together with the air forming the rich-side mixture, remain and accumulate in the rich-side mixture introduction channel, the possibility of the first communication holes being clogged is reduced owing to the arrangement that the first communication holes are each provided at an upper position than the rich-side mixture introduction channel. Furthermore, even if in the combustion stopped state, airborne dust or the like enters from the rich-side flame holes at the upper end and falls downward in the first supply channel, such dust is collected at a lower position than each first communication hole, thereby making it possible to ensure the flowing-in of rich-side mixture through each first communication hole without any obstruction.

In addition, it may be arranged in such a way that each of the first communication holes formed in the wall pair is formed in the shape of a long hole which is elongated in a direction in which the rich-side mixture introduction channel extends. As a result of such arrangement, each first communication hole is formed to be elongated in a corresponding direction to the direction in which the rich-side mixture introduction channel extends, i.e., in the direction in which the rich-side mixture flows, whereby the rich-side mixture is more smoothly admitted into the first supply channel from the rich-side mixture introduction channel by way of each first communication hole. As a result of such arrangement, the flow of rich-side mixture flowing into the first supply channel through both the first communication holes becomes more smooth while certainly preventing the occurrence of conditions (such as collision against wall surfaces) that contribute to adhesion and accumulation of dust particles.

In addition, in the rich-lean combustion burner of the present invention, it may be arranged in such a way that the size of opening of each of the first, the second and the third communication holes is set so that either the size of opening of the central rich-side flame holes becomes smaller than the size of opening of the outer rich-side flame holes, or the amount of the rich-side mixture to be supplied to the central rich-side flame holes becomes less than the amount of the rich-side mixture to be supplied to the outer rich-side flame holes. As a result of such arrangement, rich-side flames produced in the central rich-side flame holes can be easily made smaller than rich-side flames produced in the outer rich-side flame holes and can be increased in their surface area so as to facilitate their contact with surrounding air. This makes it possible to control the possibility that rich-side flames produced in the central rich-side flame holes undergo a combustion air shortage due to no flowing of secondary air in vicinity thereof. In addition, secondary air is supplied between the adjoining rich-lean combustion burners from a lower space thereof through a great number of small bores on a current plate disposed in a combustion apparatus.

Furthermore, in the rich-lean combustion burner of the present invention, it may be arranged in such a way that the flow of a lean-side mixture introduced into a single lean-side mixture introduction channel is diverged into two lean-side mixture supply channels for individual supply of the lean-side mixture to the two lean-side flame hole rows, and that the formation member for partition formation of the first supply channel is disposed so as to divide a downstream space of the lean-side mixture introduction channel in half whereby to partition-form the two lean-side mixture supply channels. As a result of such arrangement, it becomes possible to partition-form two lean-side mixture supply channels by use of the formation member for partition formation of the first supply channel, whereby the lean-side mixture is individually supplied to the two lean-side flame hole rows without causing any constructional complexity and without increasing the number of constructional members.

Advantageous Effects of Invention

As has been described above, according to the rich-lean combustion burner of the present invention in which the rich-side flame holes and the lean-side flame holes are arranged in order of RICH-LEAN-RICH-LEAN-RICH, it becomes possible that the flow of the rich-side mixture introduced from the rich-side mixture introduction channel is diverged for individual supply to the central rich-side flame hole row through the first communication hole formed in the projecting portion projecting into the rich-side mixture introduction channel and to the pair of the outer rich-side flame hole rows through the second and the third communication holes formed in the formation member for partition formation of the rich-side mixture introduction passage. Consequently, even for the case of the aforesaid burner having a rich-side flame/lean-side flame order of RICH-LEAN-RICH-LEAN-RICH, it becomes possible to ensure that the rich-side mixture is smoothly diverged and then supplied to each rich-side flame hole by a simple structure. In addition, it becomes possible to easily provide the supply of rich-side mixture to each rich-side flame hole at the same flow rate, at the same flow velocity or at the same pressure by the setting of the opening area of the first, the second and the third communication holes or by other like adjustment, thereby making it possible to certainly provide the supply of rich-side mixture at the same air ratio.

In particular, the following advantageous effects are achieved owing to the arrangement that the rich-side mixture introduction channel longitudinally extends, with its downstream end closed, that the first supply channel is partition-formed between a pair of walls situated facing each other in the projecting portion of the formation member, with a predetermined lateral inner width spaced therebetween and that the first communication hole in fluid communication with the first supply channel is formed in each of the wall pair wherein both the first communication holes are formed so as to pass through the wall pair in alignment with each other. That is, both the first communication holes formed in the wall pair pass therethrough in alignment with each other in the lateral direction, thereby being placed in a state of being in fluid communication with the rich-side mixture introduction channel without any obstruction relative to the lateral direction. This enables the rich-side mixture flowing towards the first supply channel via each first communication hole from the rich-side mixture supply channel to smoothly flow towards and into the first supply channel without collision against obstacles such as wall surfaces. Therefore, it becomes possible to prevent the possibility of adhesion and accumulation of dust particles likely of being contained in the air forming the rich-side mixture due to collision against obstacles such as wall surfaces and consequently, the resistance to linting is improved, thereby enhancing the stability of combustion.

In addition, owing to the arrangement that each of the first communication holes formed in the wall pair is formed so as to have an opening the size of which is equal to or in excess of the inner width between the wall pair at the first communication hole formation location, it becomes possible to more certainly avoid the occurrence of adhesion and accumulation of dust particles. That is, since not only both the first communication holes are just in alignment with each other but also they have a large opening, this makes it possible to prevent the entire flow of the inflowing rich-side mixture from collision against obstacles such as wall surfaces.

Owing to the arrangement that in order to leave a dust-collection inner space in the rich-side mixture supply channel, more specifically, on the side nearer to the closed end of the rich-side mixture supply channel than the first communication hole formation location, each of the first communication holes formed in the wall pair is formed in the projecting portion at a position situated nearer to the upstream of the rich-side mixture introduction channel. As a result of such arrangement, even in the case where dust particles are contained in the rich-side mixture present in the rich-side mixture introduction channel, they are held in the inner space downstream of each first communication hole, thereby making it possible to prevent their entrance to the first supply channel from each first communication hole.

Owing to the arrangement that each of the first communication holes formed in the wall pair is formed in the projecting portion at a position overlying the rich-side mixture introduction channel, each of the first communication holes is made to correspond to the flow of rich-side mixture flowing through the rich-side mixture introduction channel, thereby enabling the rich-side mixture to smoothly flow into the first communication holes. In addition, even in the case where dust particles, which have entered together with the air forming the rich-side mixture, remain and accumulate in the rich-side mixture introduction channel, the possibility of the first communication holes being clogged is reduced owing to the arrangement that the first communication holes are each provided at the upper position than the rich-side mixture introduction channel. Besides, even if in the combustion stopped state, airborne dust or the like enters from the rich-side flame holes at the upper end and falls downward in the first supply channel, such dust is collected at the lower position than each first communication hole, thereby making it possible to ensure the flowing-in of rich-side mixture through each first communication hole without any obstruction.

In addition, owing to the arrangement that each of the first communication holes formed in the wall pair is formed in the shape of a long hole which is elongated in the direction in which the rich-side mixture introduction channel extends, each of the first communication holes is formed to be elongated in a corresponding direction to the direction in which the rich-side mixture flows, whereby the rich-side mixture is more smoothly admitted into the first supply channel from the rich-side mixture introduction channel by way of each of the first communication holes. As a result of such arrangement, the flow of rich-side mixture flowing into the first supply channel through both the first communication holes becomes more smooth while certainly preventing the occurrence of conditions (such as collision against wall surfaces) that contribute to adhesion and accumulation of dust particles.

Owing to the arrangement that the size of opening of each of the first, the second and the third communication holes is set so that either the size of opening of the central rich-side flame holes becomes smaller than the size of opening of the outer rich-side flame holes, or the amount of rich-side mixture to be supplied to the central rich-side flame holes becomes less than the amount of rich-side mixture to be supplied to the outer rich-side flame holes, rich-side flames produced in the central rich-side flame holes can be easily made smaller than rich-side flames produced in the outer rich-side flame holes and can be increased in their surface area so as to facilitate their contact with surrounding air. This makes it possible to control the possibility that rich-side flames produced in the central rich-side flame holes undergo a combustion air shortage due to no flowing of secondary air in vicinity thereof. In addition, secondary air is supplied between the adjoining rich-lean combustion burners from a lower space thereof through a great number of small bores on a current plate disposed in a combustion apparatus.

Owing to the arrangement that the flow of a lean-side mixture introduced into a lean-side mixture introduction channel is diverged into two lean-side mixture supply channels for individual supply of the lean-side mixture to the two lean-side flame hole rows, and that the formation member for partition formation of the first supply channel is disposed so as to divide the downstream space of the lean-side mixture introduction channel in half whereby to partition-form the two lean-side mixture supply channels, it becomes possible to partition-form two lean-side mixture supply channels by use of the formation member for partition formation of the first supply channel, whereby the lean-side mixture is individually supplied to each of the two lean-side flame hole rows without causing any constructional complexity and without increasing the number of constructional members.

Finally, by forming a combustion apparatus by use of any one of the foregoing rich-lean combustion burners, it becomes possible for the combustion apparatus thus formed to achieve the aforesaid various advantageous operation/working effects.

DESCRIPTION OF EMBODIMENTS

Hereinafter, embodiments of the present invention will be described with reference to the drawings.

Figure 1:
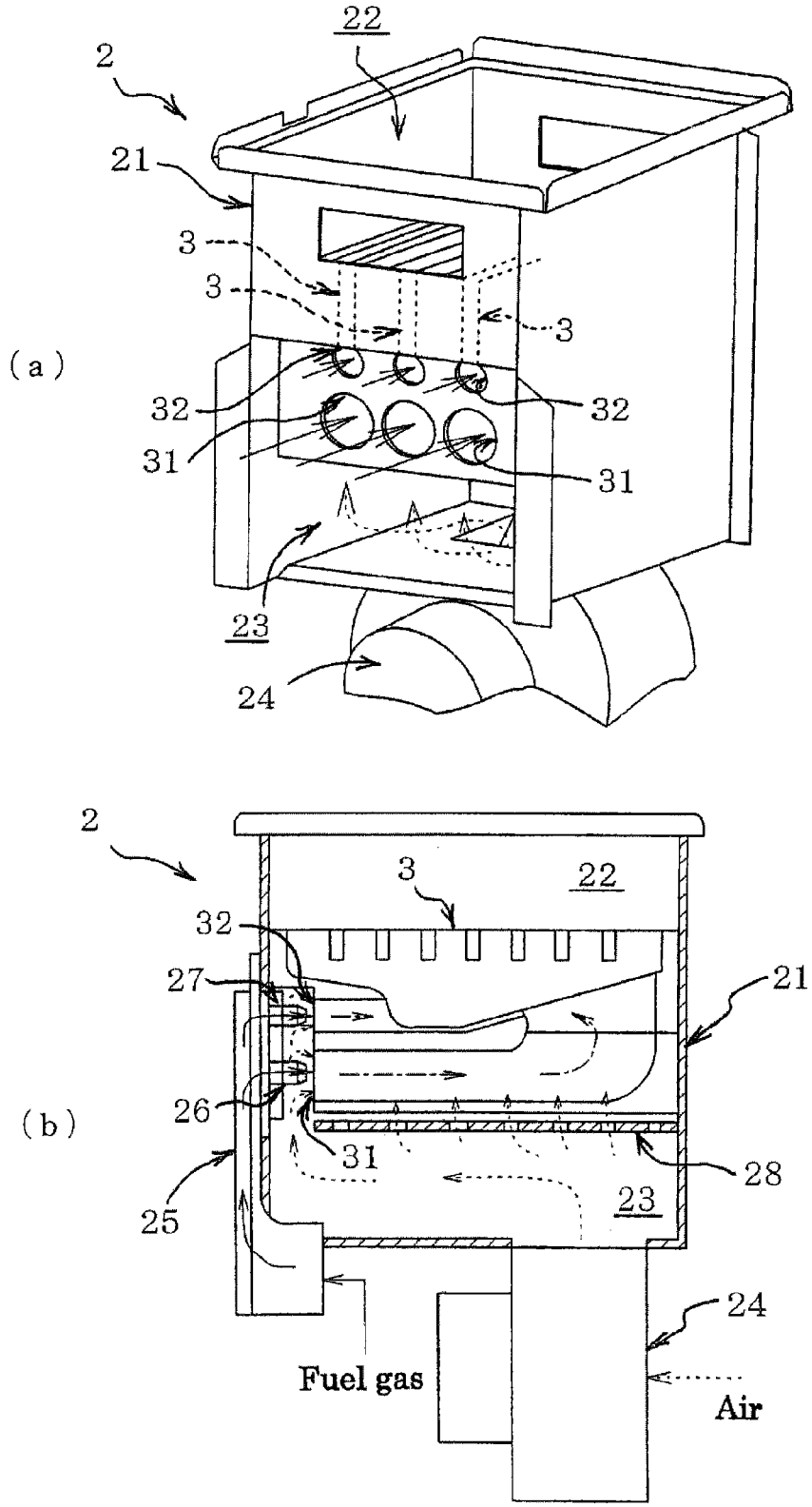
FIG. 1, comprised of FIG. 1(*a*) and FIG. 1(*b*), shows an example of a combustion apparatus into which a rich-lean combustion burner according to the present invention is incorporated, wherein FIG. 1(*a*) is an illustration diagram showing a perspective view of the rich-lean combustion burner and FIG. 1(*b*) is an illustration diagram showing a cross-sectional view of the rich-lean combustion burner.

Referring to FIG. 1, there is shown a combustion apparatus 2 into which rich-lean combustion burners 3, 3, . . . according to each of embodiments of the present invention are incorporated. The combustion apparatus 2 includes a can body 21 in which a set of burners, made up of a predetermined number of rich-lean combustion burners 3, 3, . . . which are laterally adjacently arranged, is firmly fixed. The upper space of the can body 21 serves as a combustion space 22. Combustion air is supplied to the lower space of the can body 21 (indicated by reference numeral 23) from an air distribution fan 24. There is disposed on one side of each of the rich-lean combustion burners 3 a gas manifold 25 (shown only in FIG. 1(*b*)). Projected from the gas manifold 25 to its corresponding rich-lean combustion burner 3 are two gas nozzles 26, 27. One of the gas nozzles (the lower one), i.e., the gas nozzle 26, is configured so as to be able to jet fuel gas in the direction of a first supply port 31 of the rich-lean combustion burner 3 while on the other hand the other of the gas nozzles (the upper one), i.e., the gas nozzle 27, is configured so as to be able to jet fuel gas in the direction of a second supply port 32 of the rich-lean combustion burner 3. Air from the lower space 23 is forced in from around each of the gas nozzles 26 and 27 by discharge pressure of the air distribution fan 24 so that both fuel gas and air are supplied to the first and the second supply ports 31, 32. In this case, it is arranged such that the diameter of the first supply port 31 is set to be considerably larger than the outer diameter of the nozzle 26 to thereby allow much more air to be forced in while on the other hand the diameter of the second supply port 32 is set to be slightly larger than the outer diameter of the nozzle 27 to thereby reduce the amount of air to be forced in. In this way as described above, the first supply port 31 supplies, in addition to fuel gas to be supplied, air so that the amount of air greater than the amount of fuel gas is supplied to the inside at a predetermined air ratio of in excess of 1.0, while on the other hand the second supply port 32 likewise supplies, in addition to fuel gas to be supplied, air so that the amount of air smaller than the amount of fuel gas is supplied to the inside at a predetermined air ratio of less than 1.0. In addition, there is disposed a current plate 28 (see FIG. 1(*b*)) serving as a partition between the lower space 23 and the rich-lean combustion burners 3, 3, . . . and there are opened through the current plate 28 a great number of small bores, whereby secondary air is supplied between the adjoining rich-lean combustion burners 3, 3 through these small bores.

First Embodiment

Figure 2:
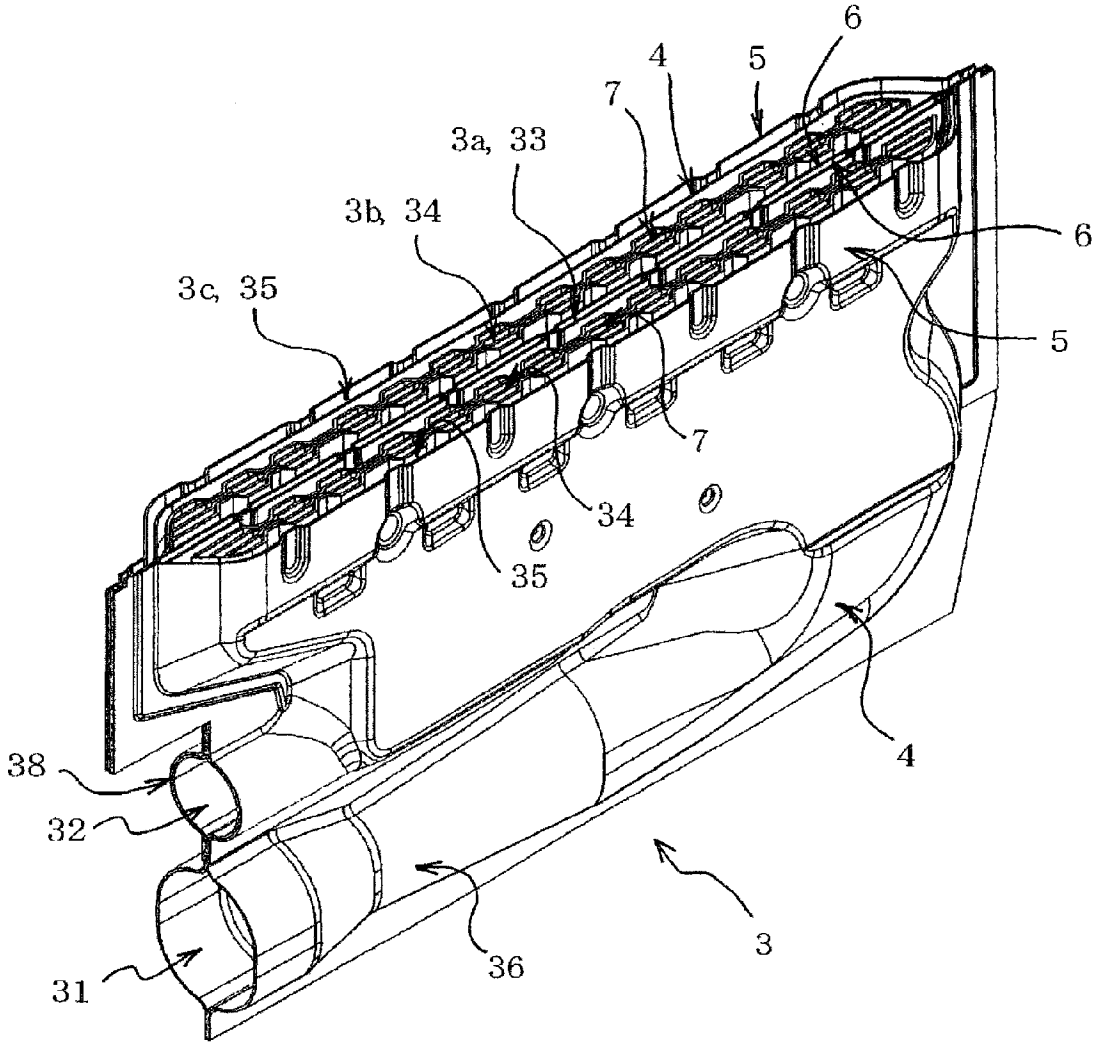
FIG. 2 is a perspective view of a rich-lean combustion burner according to a first embodiment of the present invention.
Figure 3:
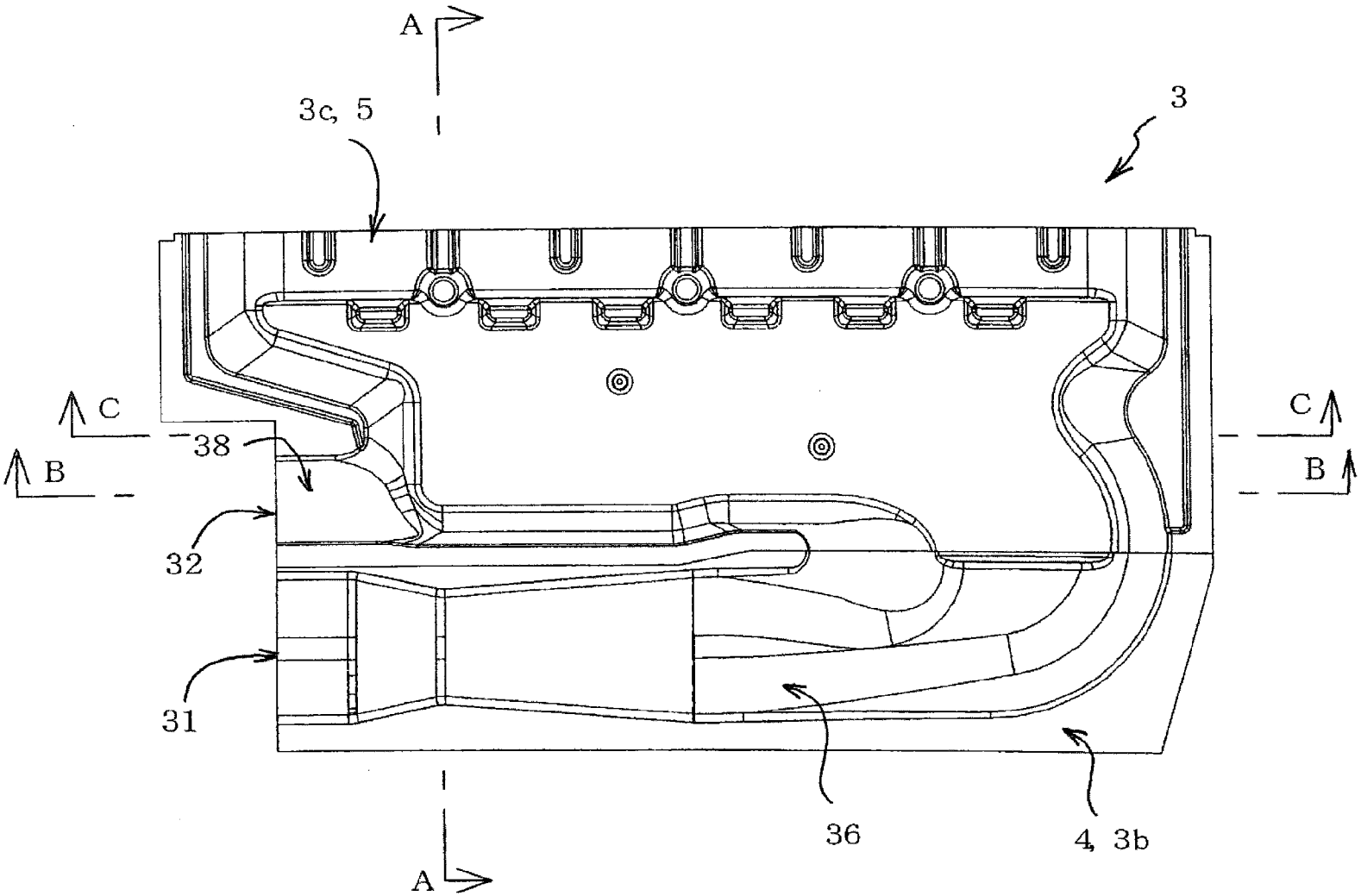
FIG. 3 is a front view of the burner of FIG. 2.

As shown in FIG. 2 depicting an example of the first embodiment, the rich-lean combustion burner 3 is composed using (i) three different types of plate members each formed of metallic plate material and worked into predetermined shapes by pressing and bending, i.e., a pair of plate members 4, 4, a pair of plate members 5, 5 and a pair of plate members 6, 6 and (ii) a pair of flame hole formation members 7, 7. The three plate member pairs 4, 4, 5, 5 and 6, 6 are placed face to face with one another as will be described later and then joined together so that the rich-lean combustion burner 3 is provided. The rich-lean combustion burner 3 thus provided is so formed as to have a flattened shape as a whole. Here assuming that the horizontal direction in FIG. 3 is the longitudinal direction (the front-back direction) and that the direction at right angles to the plane of paper of FIG. 3 is the lateral direction (the horizontal width direction), the first supply port 31 and the second supply port 32 having a smaller diameter than that of the first supply port 31 are opened respectively at a lower position and at an upper position on one longitudinal side, i.e., on the left-hand side in FIG. 3 (see also FIG. 4(*c*)), and a plurality of rows of slit-shaped flame holes where combustion flames are produced are formed in the upper end surface so as to extend in the longitudinal direction. Referring to FIG. 2 or to FIGS. 4(*a*), 4(*b*), there are shown rows of flame holes including (i) a rich-side flame hole row 33 of narrow width situated in a lateral central position and extending the longitudinal entire length, (ii) two lean-side flame hole rows 34, 34 of relatively wide width respectively situated in positions on both the lateral sides of the rich-side flame hole row 33 and extending the entire longitudinal length and (iii) two rich-side flame hole rows 35, 35 of narrow width respectively situated in positions exterior to the lean-side flame hole rows 34, 34 and extending the entire longitudinal length. And, a lean-side mixture, mixed in the inside after being supplied from the first supply port 31, is directed to each of lean-side flame holes 341 of the lean-side flame hole rows 34, 34, whereby lean-side flames are produced using the lean-side mixture thus distributed. On the other hand, a rich-side mixture, mixed in the inside after being supplied from the second supply port 32 is directed to each of rich-side flame holes 331 of the centrally situated rich-side flame hole row 33 and to each of rich-side flame holes 351 of each of the two rich-side flame hole rows 35, 35 situated in both the outer positions, whereby rich-side flames are produced using the rich-side mixture thus distributed.

Figure 4:
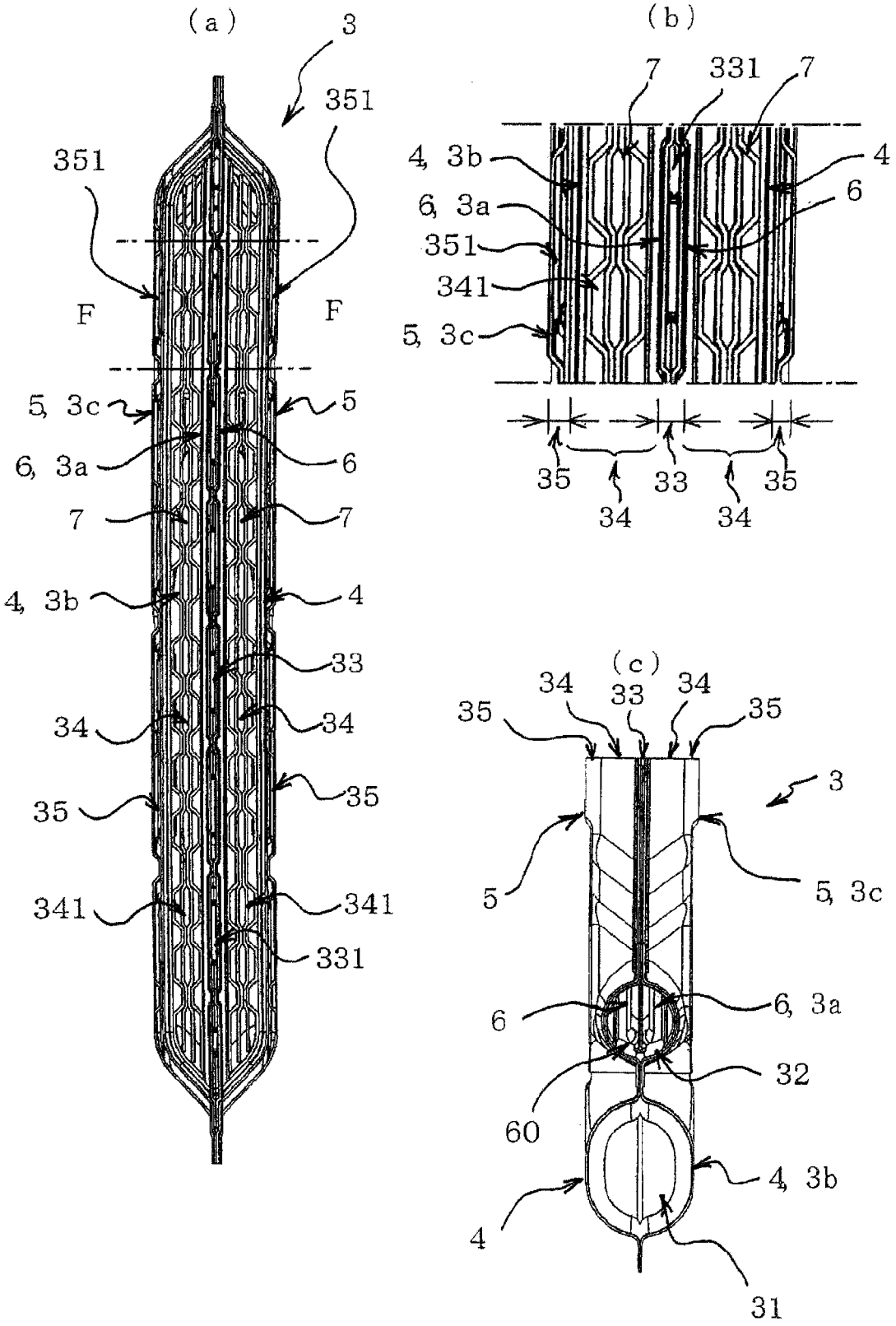
FIG. 4 is comprised of FIG. 4(*a*), FIG. 4(*b*) and FIG. 4(*c*), wherein FIG. 4(*a*) is a top plan view of the burner of FIG. 2, FIG. 4(*b*) is a partially enlarged view of an F-F part of FIG. 4(*a*) and FIG. 4(*c*) is a left-hand side view of the burner of FIG. 2.
Figure 5:
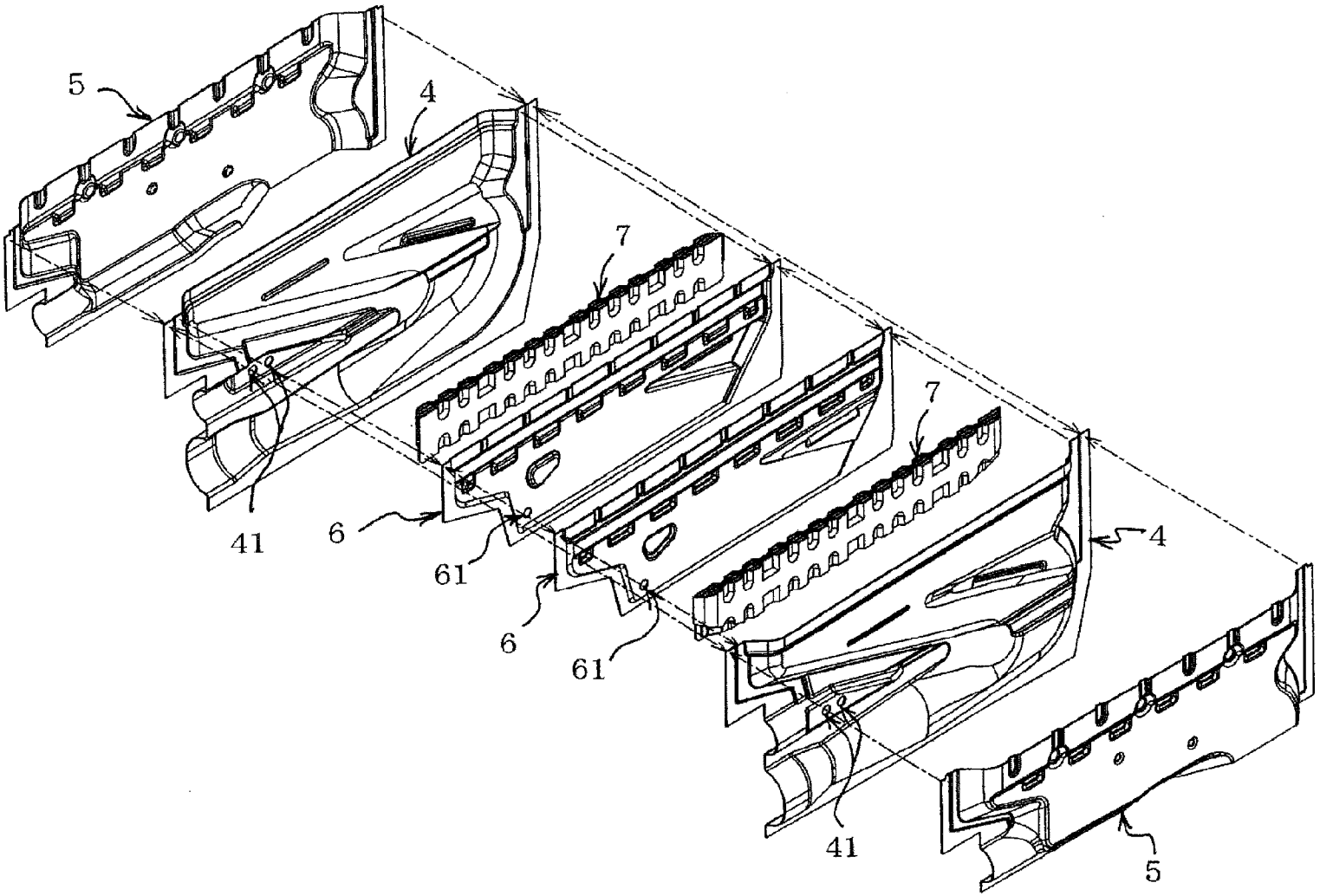
FIG. 5 is a perspective view showing, in an exploded manner, a pair of third plate members constituting a central rich-side burner part, a flame hole member constituting rows of lean-side flame holes disposed on both sides of the central rich-side burner part, a second plate member and a first plate member.
Figure 6:
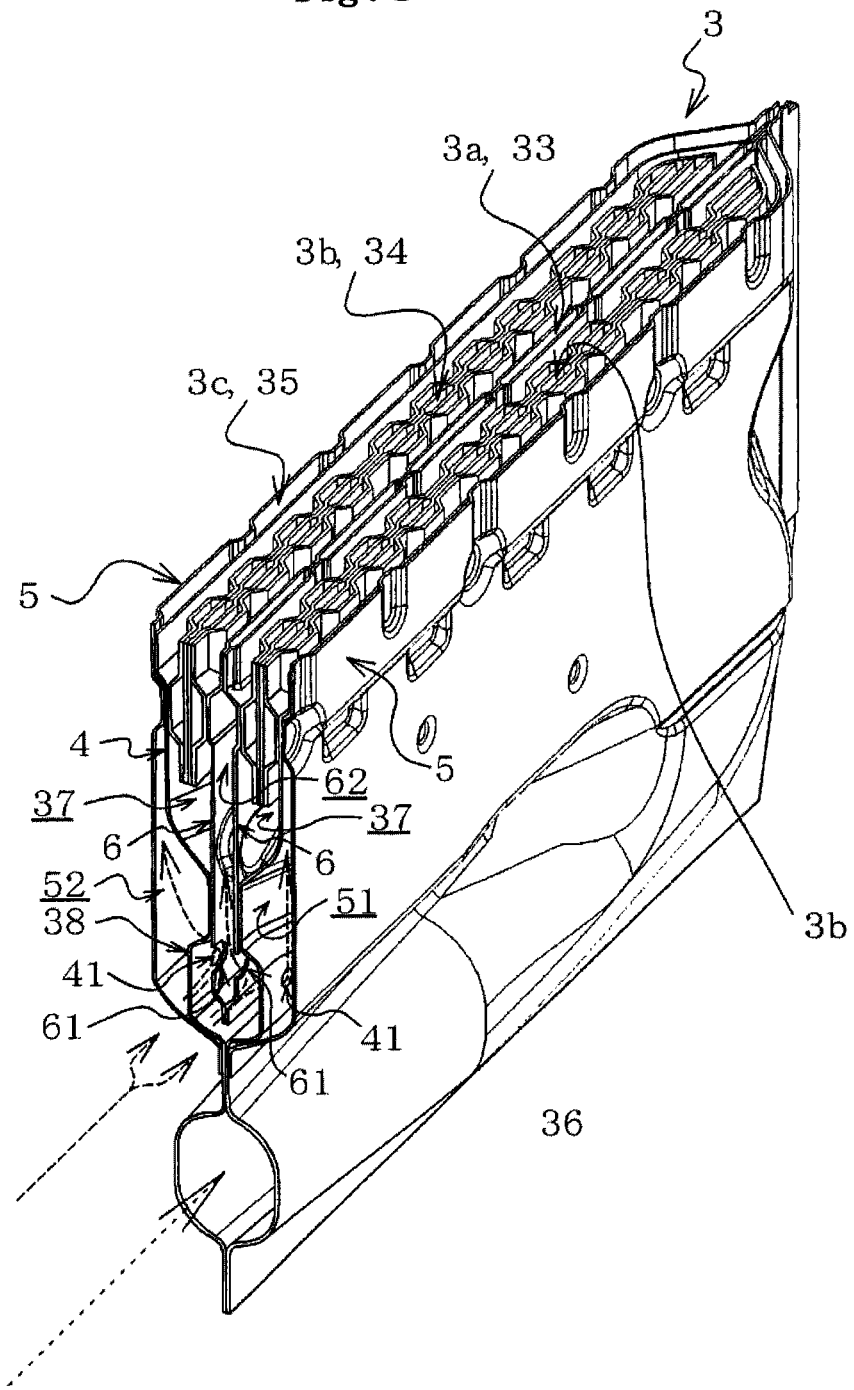
FIG. 6 is a partial perspective view when cut at a cross section along line A-A of FIG. 3.

For example, the rich-lean combustion burner 3 as described above is formed as follows. That is, as shown in FIGS. 4(*a*), 4(*b*) and FIG. 5, the three different types of plate members (i.e., the plate member pair 4, 4, the plate member pair 5, 5 and the plate member pair 6 and 6) and the flame hole formation member pair 7, 7 are used to constitute the rich-lean combustion burner 3. With the pair of the third plate members 6, 6 placed face to face with each other (see FIG. 5), their both sides and lower edge parts are joined together to thereby define, between the inner surfaces, a supply channel for rich-side mixture and form a central rich-side burner part 3*a* where rich-side flames are produced in the rich-side flame hole row 33 at the upper surface. Next, the pair of the first plate members 4, 4 are placed face to face with each other from the both lateral sides, with the central rich-side burner part 3*a* sandwiched therebetween and their both sides and lower edge parts are joined together. In doing so, both longitudinal end parts (front and back end parts) of the central rich-side burner part 3*a* are sandwichedly held between both longitudinal end parts (front and back end parts) of the first plate member pair 4, 4, thereby ensuring that the central rich-side burner part 3*a* becomes firmly fixed within the rich-lean combustion burner 3. And, there is placed in each of two upper end openings (one of which is defined between one of the first plate member pair 4, 4 and the central rich-side burner part 3*a* and the other of which is defined between the other of the first plate member pair 4, 4 and the central rich-side burner part 3*a*) a lean-side flame hole formation member 7. Because of this arrangement, the central rich-side burner part 3*a* is enclosed from both the lateral sides to thereby form a lean-side burner part 3*b* where lean-side flames are produced in the two lean-side flame hole rows 34, 34 at the upper end surface. In the lean-side burner part 3*b*, the lean-side mixture from the first supply port 31 is fed, through a supply channel defined between the inner surface of the first plate member 4 and the outer surface of the third plate member 6 of the central rich-side burner part 3*a*, to each lean-side flame hole 341 of the lean-side flame hole rows 34, 34. And the second plate member 5 is placed on the outside of each first plate member 4 of the lean-side burner part 3*b* and its both ends and each lower edge part are joined to the edge part of each first plate member 4, whereby there is formed an outer rich-side burner part 3*c* (see FIG. 2) to which the rich-side mixture is supplied through a supply channel defined between the inner surface of each second plate member 5 and the outer surface of the first plate member 4 opposite thereto so that rich-side flames are produced at each rich-side flame hole 351 of the outer rich-side flame hole rows 35, 35.

Referring next to FIGS. 6-10, a description will be given concerning the structure for supplying mixtures. Owing to the formation of the above-described lean-side burner part 3*b*, the lean-side mixture from the first supply port 31 opened on one side is fed through a tubular part 36 (see dotted arrows of FIGS. 7(*a*), 7(*b*)) to the other side. At the other side, the lean-side mixture changes direction to now flow upward, being supplied, through two inner spaces 37, 37 (see FIG. 6 and FIG. 7(*b*)) defined by partition formation (dividing) of a space between the first plate member pair 4, 4 by the third plate member pair 6, 6, to the lean-side flame hole rows 34, 34 at the upper end. The tubular part 36 and the inner spaces 37, 37 together form a lean-side mixture supply channel for the supply of lean-side mixture to the two lean-side flame hole rows 34, 34 and in addition, the tubular part 36 serves as a mixing chamber and as an introduction channel (i.e., a lean-side mixture introduction channel) for fuel gas/air supplied from the first supply hole 31. The third plate members 6, 6 constitute a formation member for partition formation of a first supply channel (to be hereinafter described) and the downstream side of the lean-side mixture introduction channel is halved (divided into two parts) by the third plate members 6, 6, whereby two lean-side mixture supply channels, i.e., the inner spaces 37, 37, are defined by partition formation.

Figure 7:
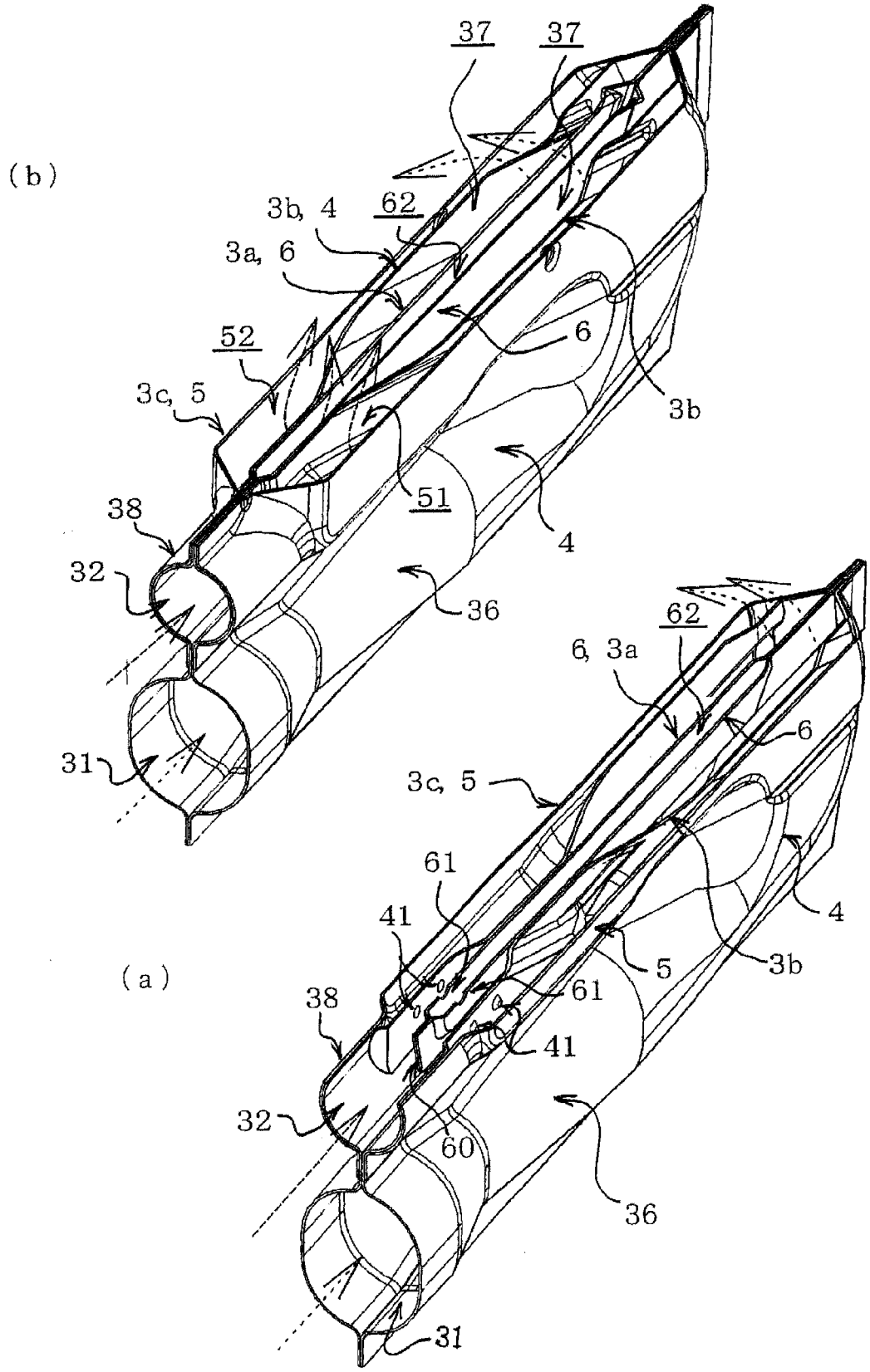
FIG. 7 is comprised of FIG. 7(*a*) and FIG. 7(*b*), wherein FIG. 7(*a*) is a perspective view when cut along line B-B of FIG. 3 and FIG. 7(*b*) is a perspective view when cut along line C-C of FIG. 3.

In addition, fuel gas and air from the second supply port 32 are mixed with each other to change to a rich-side mixture during being supplied through the tubular part 38 (see FIG. 7(*a*)) to the closed end side situated at the back (rear) and this rich-side mixture is supplied to the central rich-side burner part 3*a* and to the outer rich-side burner parts 3*c* situated respectively on the horizontal sides thereof. In other words, the central rich-side burner 3*a* has a lower end part 60 (see FIG. 7(*a*) and FIGS. 8(*a*), 8(*b*)) which is inserted from above into the closed end side of the tubular part 38 and is formed as a projecting portion projecting in midair in the tubular part 38 (see also FIG. 9). Communication holes 61, 61 are formed respectively in the third plate member pair 6, 6 constituting the lower end part 60 and each communication hole 61 brings a mixing chamber which is an inner space of the tubular part 38 and an inner space 62 of the central rich-side burner part 3*a* into fluid communication with each other. This enables the rich-side mixture present in the tubular part 38 to be supplied, through each communication hole 61 and then through the inner space 62, to the rich-side flame hole row 33. On the other hand, communication holes 41, 41, . . . are formed also in the pair of the first plate members 4, 4 constituting the tubular part 38. Owing to each communication hole 41 of the first plate member 4 situated on one side (the right-hand side in FIG. 6 or FIG. 8), the mixing chamber of the tubular part 38 is brought into fluid communication with an inner space 51 defined with respect to the second plate member 5 situated on the same side as the first plate member 4 on the one side. Likewise, owing to each communication hole 41 of the first plate member 4 situated on the other side (on the left-hand side in FIG. 6 or FIG. 8), the mixing chamber of the tubular part 38 is brought into fluid communication with an inner space 52 defined with respect to the second plate member 5 situated on the same side as the first plate member 4 on the other side. As a result of such arrangement, the rich-side mixture present in the tubular part 38 is supplied, through each communication hole 41 and then through the inner space 51 on the one side, to the rich-side flame hole row 35 on the one side, while on the other hand the rich-side mixture present in the tubular part 38 is likewise supplied, through each communication hole 41 and the inner space 52 on the other side, to the rich-side flame hole row 35 on the other side. The communication hole 61 is a "first communication" hole as set forth in the attached claims. The communication hole 41 in fluid communication with the inner space 51 is a "second communication hole" as set forth in the attached claims. The communication hole 41 in fluid communication with the inner space 52 is a "third communication hole" as set forth in the attached claims.

In addition, together with the tubular part 38, the internal spaces 51, 52, 62 constitute rich-side mixture supply channels and in addition, the tubular part 38 serves also as a mixing chamber and as an introduction channel (i.e., a rich-side mixture introduction channel) for fuel gas/air supplied from the second supply port 32. To sum up, the inner space 51 is a "second supply channel" as set forth in the attached claims, the inner space 52 is a "third supply channel" as set forth in the attached claims and the inner space 62 is a "first supply channel" as set forth in the attached claims.

Figure 8:
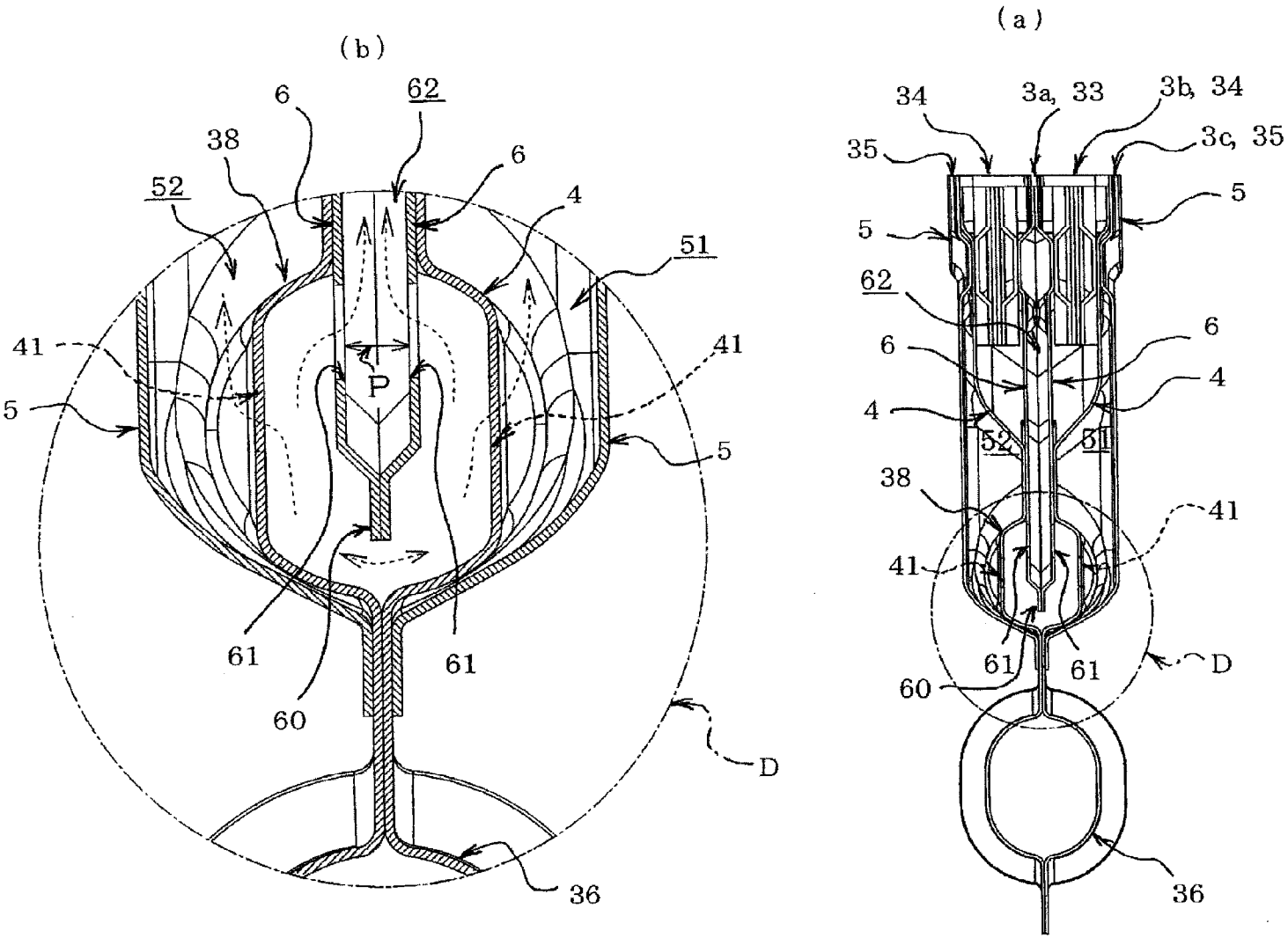
FIG. 8 is comprised of FIG. 8(*a*) and FIG. 8(*b*), wherein FIG. 8(*a*) is an illustration diagram in cross section taken along line A-A of FIG. 3 and FIG. 8(*b*) is an illustration diagram showing, in an enlarged manner, a part D of FIG. 8(*a*)
Figure 9:
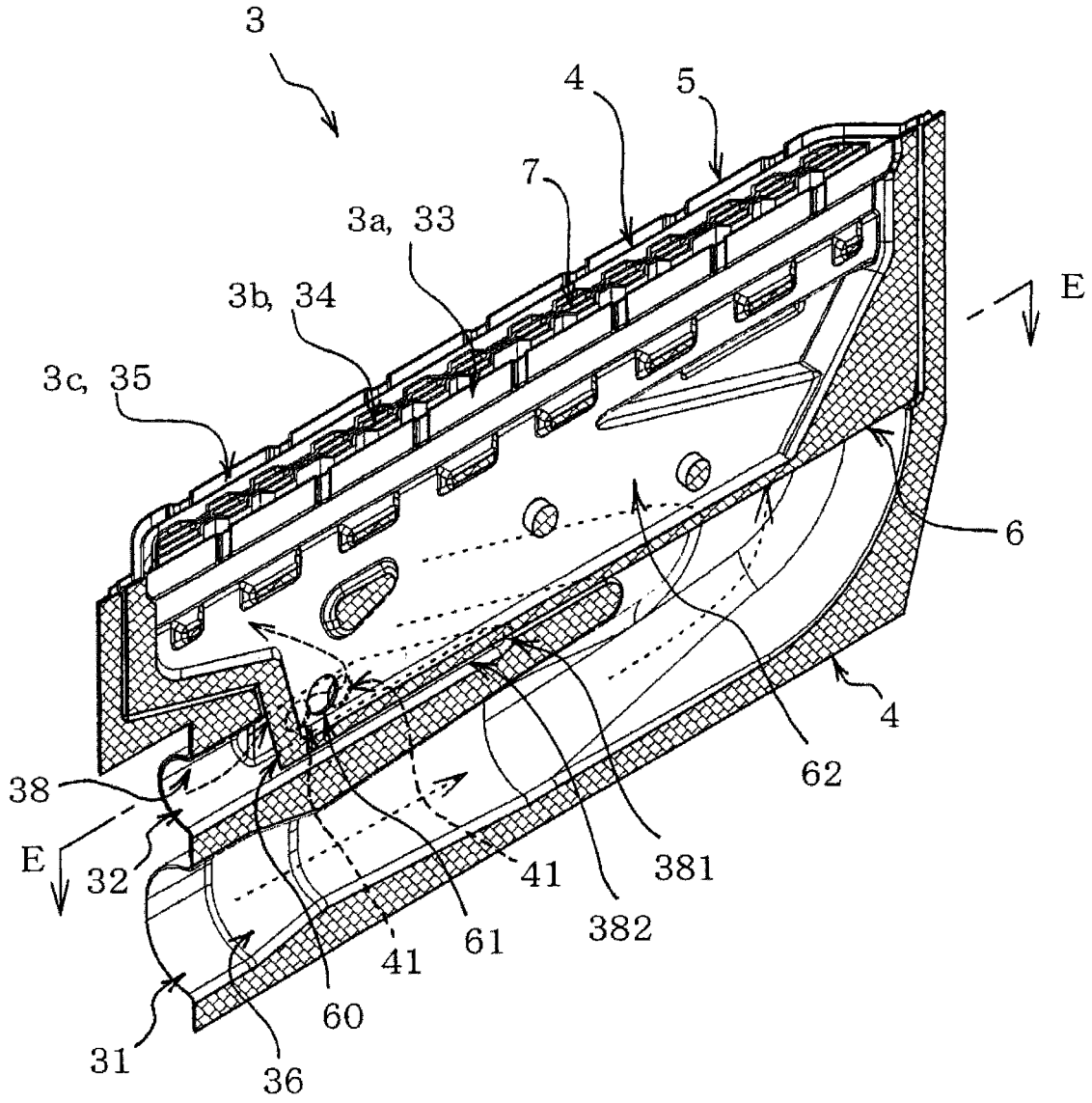
FIG. 9 is an illustration view illustrating, in the form of a perspective view, a state when cut and broken down at a lateral central position wherein portions shaded in the figure indicate joint surfaces.
Figure 10:
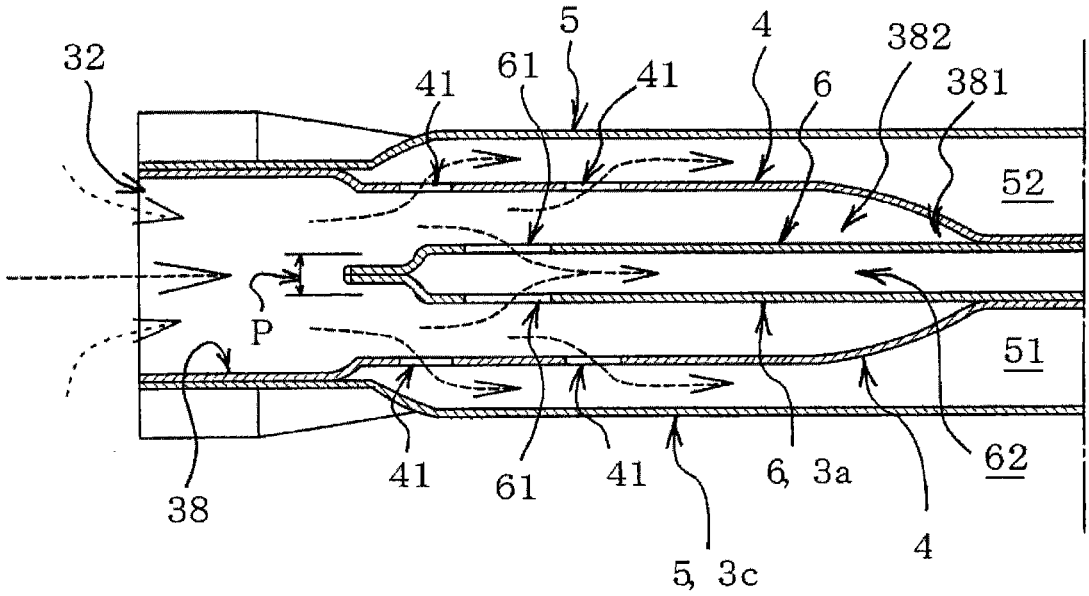
FIG. 10 is a partially enlarged cross-sectional illustration view taken along line E-E of FIG. 9.
Figure 19:
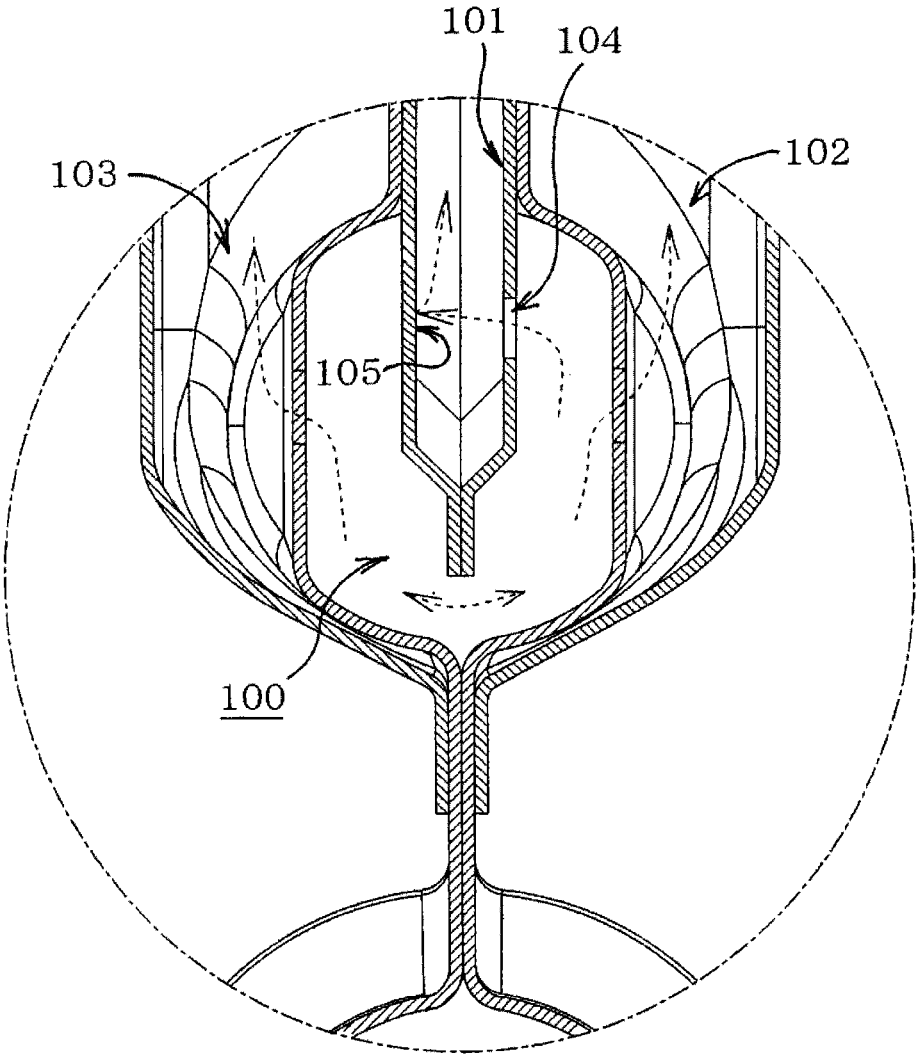
Fig. 19 RELATED ART
FIG. 19 is an illustration view for explaining problems to be solved by the present invention and is an enlarged, cross-sectional illustration view corresponding to FIG. 8(*b*).

The communication holes 61, 61 are formed respectively through the pair of the third plate members 6, 6 to be joined together with facing each other and in addition, both the communication holes 61, 61 are disposed so as to pass through the pair of the third plate members 6, 6 substantially in alignment with each other in the horizontal direction (see, for example, FIG. 8(*b*) and FIG. 10). That is to say, although in the third plate members 6, 6, their pair of walls are situated facing in the horizontal width direction (the lateral direction) with respect to the mixing chamber of the tubular part 38, the communication holes 61, 61 formed in the third plate members 6, 6 are passed therethrough in alignment with each other, thereby being placed in a state of being, without any interruption in the horizontal width direction (the vertical direction in FIG. 10), in fluid communication with the rich-side mixture introduction channel constituted by the tubular part 38. Therefore, the rich-side mixture flowing via each communication hole 61 towards the inner space 62 from within the tubular part 38 is allowed to smoothly flow into the inner space 62 without any collision against wall surfaces such as the facing wall 105 (see FIG. 19). This makes it possible to prevent the possibility that due to collision against obstacles such as wall surfaces, dust particles likely of being contained in the air constituting the rich-side mixture will adhere and accumulate. In addition, since the point is to avoid the occurrence of adhesion and accumulation due to collision against wall surfaces, the communication holes 61, 61 are not necessarily passed through the third plate members 6, 6 in exact alignment with each other, that is, it suffices that the communication holes 61, 61 are more or less in alignment with each other and in addition, there is no need that the orientation of the communication holes 61, 61 precisely coincides with the horizontal width direction and therefore, it suffices that the communication holes 61, 61 are approximately oriented towards the horizontal width direction.

In addition, the diameter of opening of each communication hole 61 is formed so as to be equal to or larger than the inner width, P, of the inner space 62 (the wall space between the pair of the third plate members 6, 6) at the position where both the communication holes 61, 61 are formed (see FIG. 8(*b*) and FIG. 10). Therefore, not only the communication holes 61, 61 are passed through the third plate members 6, 6 in alignment with each other and in addition, but also the entire flow of the inflowing rich-side mixture is prevented from collision against obstacles such as wall surfaces, thereby further ensuring that the occurrence of adhesion and accumulation of dust particles is avoided. Accordingly, each communication hole 61 is preferably formed such that the amount of opening (the diameter of opening) is made as large as possible, provided that the setting of the amount of opening in the light of adjustment or control of the supply of rich-side mixture to the central rich-side flame holes is satisfied.

Furthermore, as shown in, for example, FIG. 8(*b*), each communication hole 61 is formed so as to open at a position (an upper position) situated nearer to the upper of the space of the tubular part 38 (the rich-side mixture introduction channel). In other words, each communication hole 61 is formed so as to open at a position above the portion of the lower end part 60 projecting into the tubular part 38. The reason for this is as follows. Since the rich-side mixture, flowing backward towards the closed end 381 at the rear end from the second supply port 32 at the front end in the tubular part 38, flows slightly obliquely upward as it advances deep inside of the tubular part 38, the setting of position is made so as to allow the rich-side mixture to more easily flow into each communication hole 61. In addition, even when dust particles entering along with the air constituting the rich-side mixture remain and accumulate in the rich-side mixture introduction channel, it is possible to reduce, by forming each communication hole 61 at a position situated nearer to the upper of the tubular part 38 serving as a rich-side mixture introduction channel, the possibility that each communication hole 61 becomes closed. Further, this means that even when airborne dust or the like enters from each opening of the row of the rich-side flame holes 33 at the upper end and then falls downward through the inner space 62, such dust will be collected at the position lower than each communication hole 61 of the lower end part 60. Therefore, it becomes possible to prevent the flowing-in of rich-side mixture through each communication hole 61 from being interrupted, thereby contributing to securing the flowing-in of rich-side mixture. In addition, each of the communication holes 61, 61 is arranged at a position situated further nearer to the front (a position situated nearer to the upstream) within the range of the rear half part (the downstream side part) of the tubular part 38 (the rich-side mixture introducing channel) extending, in the front-back direction, from the second supply port 32 up to the closed end 381. That is, as a pocket part 382 (see FIG. 10) for collecting dust particles, there is left in the tubular part 38 an inner space situated on the side rearward of each communication hole 61 and extending up to the closed end 381. Because of this, even when the rich-side mixture present in the tubular part 38 contains dust particles, the dust particles will be collected in the pocket part 382, thereby preventing such a condition that dust particles flow into the inner space 62 from each communication hole 61 from occurring.

Next, here are added remarks about the relationship between the communication holes 61, 61 and the communication holes 41, 41. The communication holes 61, 61 and the communication holes 41, 41 on the both sides may be formed so as to open at opposing positions in the lateral direction. Alternatively, the communication holes 61, 61 and the communication holes 41, 41 may be formed so as to open at positions out of alignment from each other with respect to the longitudinal direction, as in the present embodiment (see, for example, FIG. 10). Stated in another way, it suffices that the communication holes 61, 61 are opened in a region on the side (the rear side) of the closed end 381 of the tubular part 38 constituting a rich-side mixture introduction channel, whereas correspondingly to the side of the closed end 381 of the tubular part 38 where the communication holes 61, 61 are opened, the communication holes 41, 41, . . . are also opened in the same region on the side of the closed end 381 of the tubular part 38. In addition, in the present embodiment, there is shown an example in which there is formed on each lateral side a single communication hole 61, which arrangement, however, should not be considered as a limitation. There may be formed on each side a plurality of communication holes, for example, two or three communication holes on each side.

In the embodiment as described above, the two lean-side flame hole rows 34, 34 are sandwiched, from both sides, by either the rich-side flame hole rows 35, 33 or the rich-side flame hole rows 33, 35, whereby each lean-side flame produced in both the lean-side flame hole rows 34, 34 is enclosed from both sides by rich-side flames. That is, it is possible to arrange flames in the lateral direction in order of RICH-LEAN-RICH-LEAN-RICH. Owing to this, even in the case where there are provided two rows of lean-side flame holes 34, 34 to increase the area of lean-side flame hole row, it is possible to prevent lean-side flames from increasing in length, whereby the height of the combustion chamber 22 (see FIG. 1) can be held short. And, by increasing the area (ratio) of lean-side flame hole while holding the height of the combustion chamber short, it becomes possible to achieve further NOx reduction or further stabilized combustion. In addition, as compared to the case where a single rich-lean combustion burner is configured by sandwiching of a single row of lean-side flame holes by rows of rich-side flame holes from both sides, it becomes possible to efficiently achieve better weight saving of the rich-lean combustion burner in realizing the same lean-side flame hole area. Furthermore, the rich-side mixture, mixed after being introduced into the tubular part 38 from a single fuel gas/air supply port (i.e., the second supply port 32), is diverged into sub-flows towards to their corresponding inner space 62, 51, 52, respectively, through the communication holes (namely, through the communication holes 61, 61 of the central rich-side burner part 3*a*, through the communication holes 41, 41 of the outer rich-side burner part 35 situated on one side and through the communication hole 41, 41 of the outer rich-side burner part 35 situated on the other side) that are opened in fluid communication with the region on the side of the closed end of the tubular part 38. Owing to this, even in the case of the formation of three rich-side flame hole rows 35, 33, respectively in the center and on both outsides, the flow of rich-side mixture can be smoothly and certainly diverged by a simple structure into sub-flows for supplying to the rich-side flame hole rows 35, 33, 35.

Furthermore, in addition to the effects as set forth beforehand, it is possible to provide the following special effects. In other words, even when the thickness, relative to the horizontal width direction, of the pair of the third plate members 6, 6 constituting the central rich-side burner 3*a* is not increased but is set at a relatively thin width, it becomes possible to certainly prevent the supply of rich-side mixture from being impeded due to adhesion and accumulation of dust particles likely of being contained in the air used to produce the rich-side mixture. In particular, it is possible to certainly prevent the occurrence of conditions such as adhesion and accumulation of dust particles in the vicinity of the communication holes 61, 61 through which the rich-side mixture flows into the inner space 62 in the third plate member pair 6, 6 from the tubular part 38, thereby enhancing the performance of resistance to linting. It therefore becomes possible to smoothly supply the rich-side mixture mixed within the tubular part 38 to the rich-side flame hole row 33 of the central rich-side burner 3*a* without any trouble. Owing to this, it is possible to avoid, for example, the occurrence of deterioration and destabilization in the combustion state or ignition failure due to the occurrence of obstruction in the supply of the rich-side mixture, whereby it becomes possible to accomplish improvement in combustion stability. This also means that the central rich-side burner 3*a* is made relatively thin in its lateral thickness, and as a rich-lean combustion burner with an order of RICH-LEAN-RICH-LEAN-RICH, there can be realized a compact one.

Other Examples of First Embodiment

Figure 11:
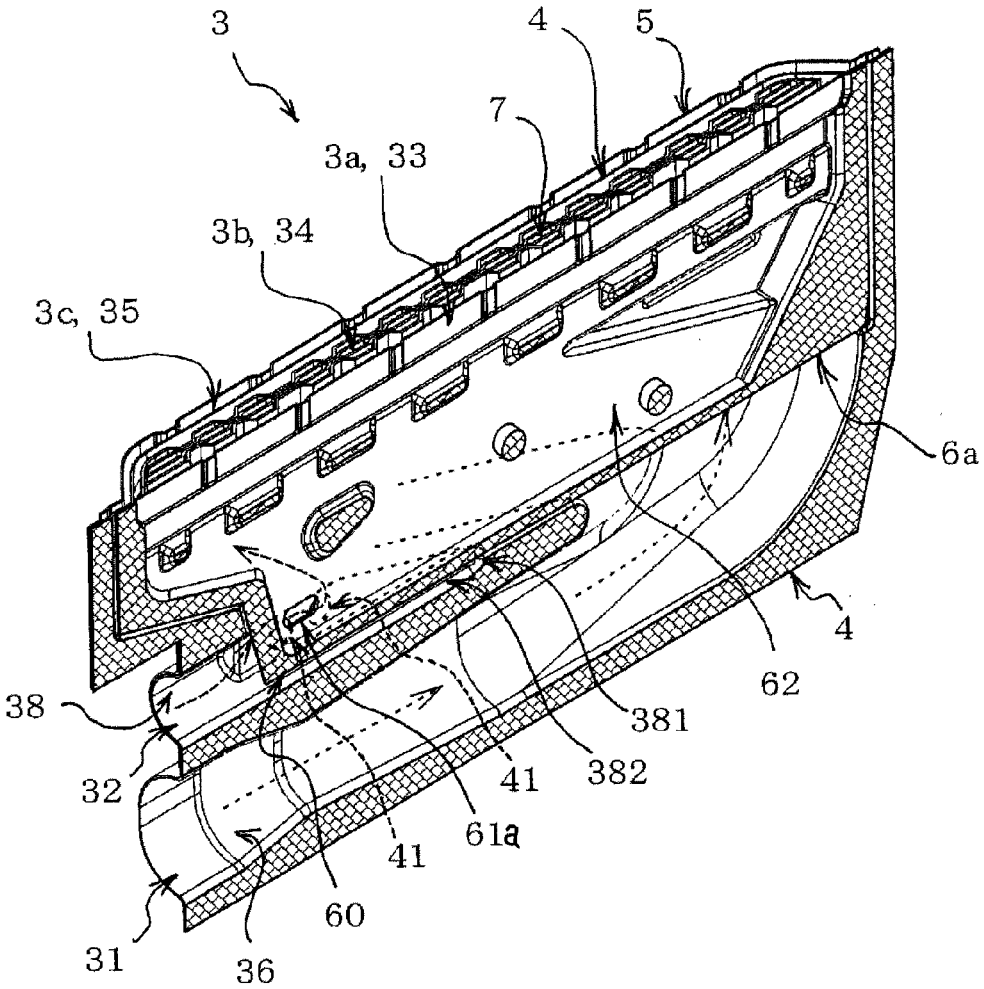
FIG. 11 is comprised of FIG. 11(*a*) and FIG. 11(*b*), wherein FIG. 11(*a*) is a corresponding view to FIG. 9 showing another example of the first embodiment and FIG. 11(*b*) is a partial front view of FIG. 11(*a*) in which portions shaded in the figure indicate joint surfaces.
Figure 11:
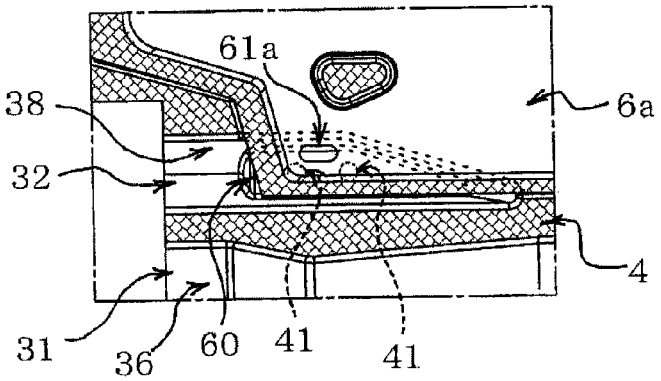

Referring to FIG. 11, there is shown a third plate member 6*a* incorporated into a rich-lean combustion burner 3 of another example of the first embodiment. The present example differs from the first embodiment only in employing, as a substitute for the third plate member 6 of the first embodiment, the third plate member 6*a* and other configurations of this example are the same as those already described in the first embodiment. Therefore, hereinafter, a description will be given mainly in regard to the third plate member 6*a* different from that of the first embodiment and any overlapping description in regard to the other configurations is omitted here.

The third plate member 6*a* of the present example differs from the third plate member 6 of the first embodiment in that there is provided a communication hole 61*a* that is not in the shape of a circle but in the shape of a long hole elongated in the longitudinal direction (in the front-back direction). The position of formation of the communication holes 61*a*, 61*a* is the same as described in the first embodiment (that is, the communication holes 61*a*, 61*a* are formed so as to pass through in alignment with each other in the horizontal width direction and are situated nearer to the upper of the lower end part 60 and nearer to the front so that the pocket part 382 is defined at the rear. In addition, it suffices that the longitudinal length of the long hole shape of the communication hole 61*a* is made larger than at least the inner width P in the first embodiment (see FIG. 8(*b*)).

The employing of the communication holes 61*a*, 61*a* as described above enables the rich-side mixture entering the inner space 62 from the side of the tubular part 38 through both the communication holes 61*a*, 61*a* to more smoothly flow in such a state that the occurrence of conditions contributing to adhesion and accumulation of dust particles, such as collision against wall surfaces, is certainly prevented. That is to say, since each communication hole 61*a* is formed so as to elongate in a direction in which the tubular part 38 serving as a rich-side mixture introduction channel extends (i.e., in the direction that coincides with the direction of the flow of rich-side mixture). In other words, since each communication hole 61*a* is formed so as to elongate along the flow of rich-side mixture, this enables the rich-side mixture to smoothly flow into the inner space 62 from the tubular part 38. In addition, as a concrete shape for the long hole, it suffices to employ a long circular shape or an elliptic shape. Additionally, in the present example, there is shown an example in which a single communication hole 61*a* is formed on each lateral side, which, however, should not be considered as a limitation. For example, a plurality of communication holes (two or three communication holes) may be provided on each side.

Second Embodiment

Figure 12:
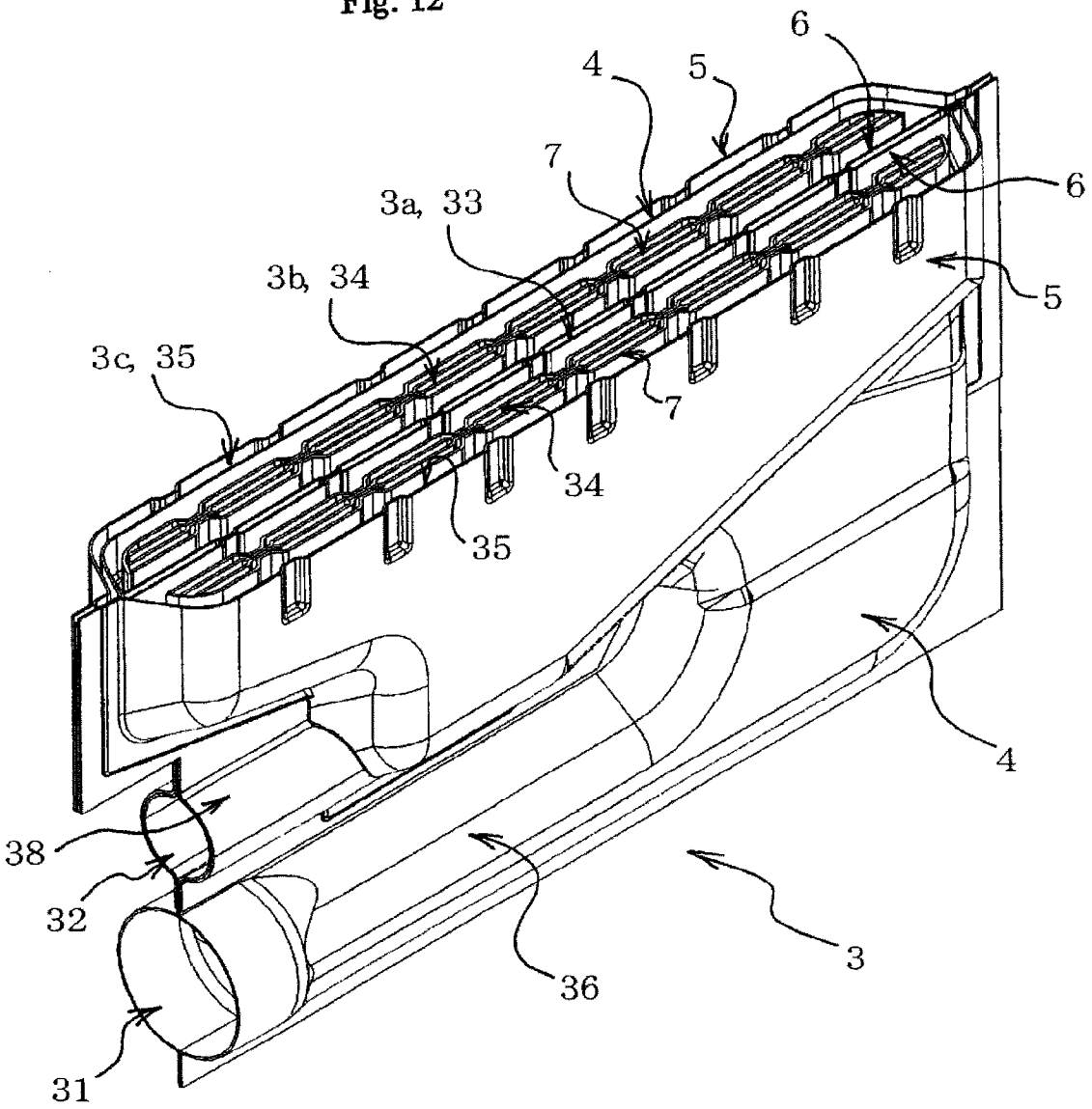
FIG. 12 is a perspective view of a rich-lean combustion burner according to a second embodiment of the present invention.
Figure 13:
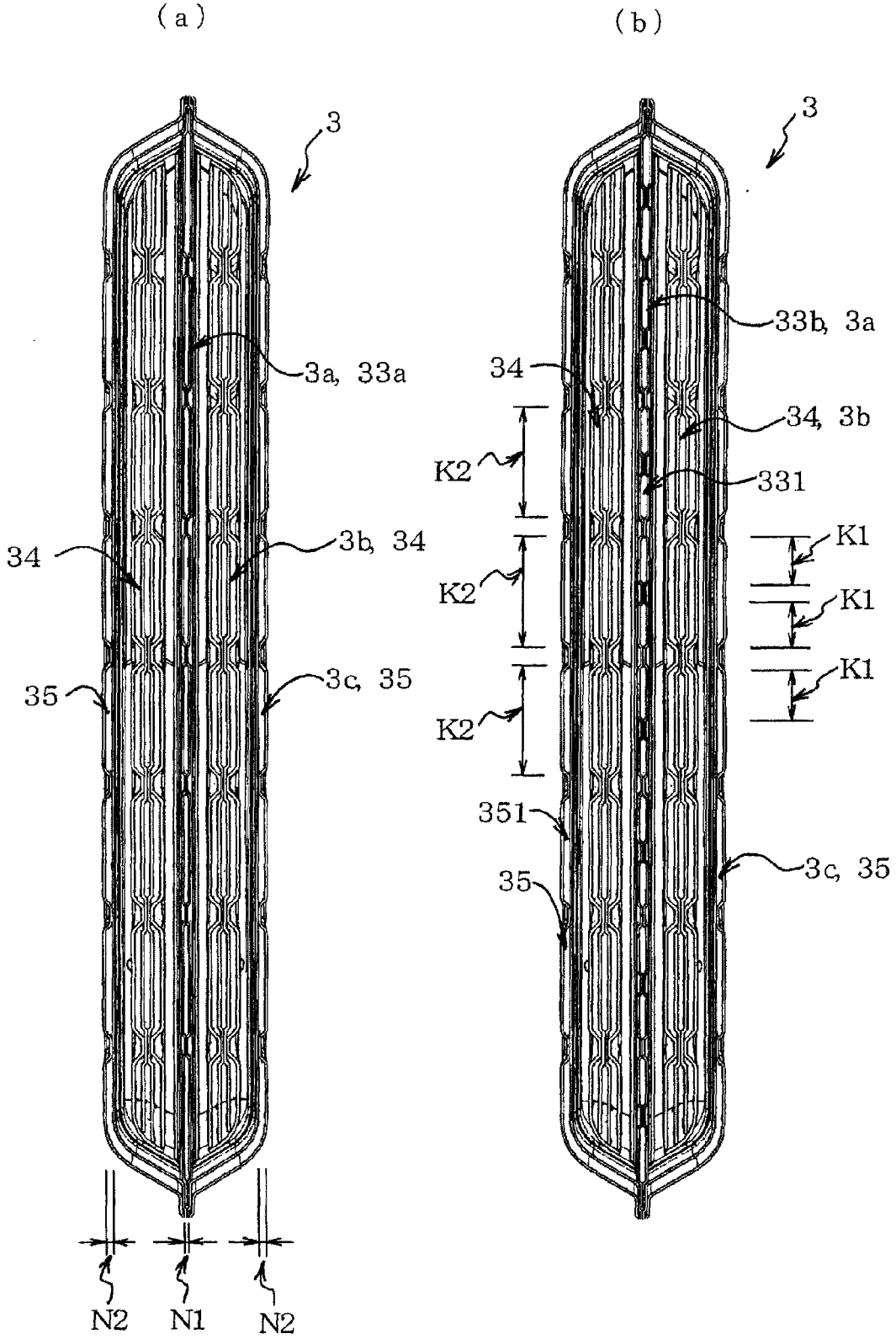
FIG. 13 is comprised of FIG. 13(*a*) and FIG. 13(*b*), wherein FIG. 13(*a*) is a top plan view of the rich-lean combustion burner of FIG. 12 and FIG. 13(*b*) is a corresponding view to FIG. 13(*a*) showing another example of the second embodiment.

FIG. 12 shows a rich-lean combustion burner 3 according to a second embodiment of the present invention and FIG. 13 shows a flame hole surface of the rich-lean combustion burner 3. The second embodiment is characterized in that rich-side flames produced in a central rich-side flame hole row 33*a* or 33*b* will not undergo a shortage of combustion air. In other words, the aspect of the second embodiment is to prevent the possibility of undergoing a shortage of combustion air due to the fact that there flows no secondary air in the vicinity. Other configurations are almost the same as the first embodiment. Thus any overlapping description is omitted and only characteristic features of the second embodiment will be described below. As the second embodiment for preventing the possibility of undergoing a shortage of combustion air, there are given the following three first to third examples. As the second embodiment, one of the three examples may be used independently or any combination thereof may be used.

According to the first example, the inner width, N1, of the rich-side flame hole row 33*a* of the central rich-side burner 3*a* is set smaller than the inner width, N2, of the rich-side flame hole row 35 of the outer rich-side burner 3*c*, as shown in FIG. 13(*a*). According to the second example, the number of rich-side flame holes divided in the rich-side flame hole row 33*b* of the central rich-side burner 3*a* is increased to exceed the number of rich-side flame holes divided in the rich-side flame hole row 35 of the outer rich-side burner 3*c*, as shown in FIG. 13(*b*). Owing to this, the longitudinal length, K1, of each of rich-side flame holes 331 of the rich-side flame hole row 33*b* becomes smaller than the length, K2, of each of rich-side flame holes 351 of the rich-side flame hole row 35 (for example, one-half) and, thus, the surface area of rich-side flames produced in the rich-side flame hole row 33*b* increases to exceed that of rich-side flames produced in the outer rich-side flame hole row 35, thereby making it possible to increase the area of the rich-side flames produced in the rich-side flame hole row 33*b* that comes into contact with air therearound. According to the third example (not shown), the flow rate of rich-side mixture supplied through the communication hole 61 (see FIG. 6) is set smaller than the flow rate of rich-side mixture supplied through the communication hole 41. To this end, it may be arranged such that (i) the inner diameter of the communication hole 61 itself is reduced, (i) in the case where the communication hole 61 is formed in plural number on one side, the number thereof is reduced, or (iii) (i) and (ii) are combined, whereby the opening area of communication holes in fluid communication with the central rich-side flame hole row 33 is made smaller than that of communication holes in fluid communication with the outer rich-side flame hole row 35. In doing so, it is preferable that the velocity of supplying the rich-side mixture to the central rich-side flame hole row 33 is made equal to the velocity of supplying the rich-side mixture to the outer rich-side flame hole row 35.

In the first embodiment, there is a general tendency that rich-side flames produced in the outer rich-side flame hole row 35 tend to come into contact with secondary air on the outside thereof, whereas rich-side flames produced in the central rich-side flame hole row 33 tend to have difficulty in contacting with secondary air. To cope with this, in the first example, the amount of rich-side mixture discharged out from the central rich-side flame hole row 33*a* is reduced, thereby preventing the possibility of undergoing a shortage of combustion air. In the second example, rich-side flames produced in the central rich-side flame hole row 33*b* are divided small so as to easily come into contact with air therearound, thereby preventing the possibility of undergoing a shortage of combustion air. In the third example, the amount of rich-side mixture discharged out from the central rich-side flame hole row 33 is reduced, thereby preventing the possibility of undergoing a shortage of combustion air.

Third Embodiment

Figure 14:
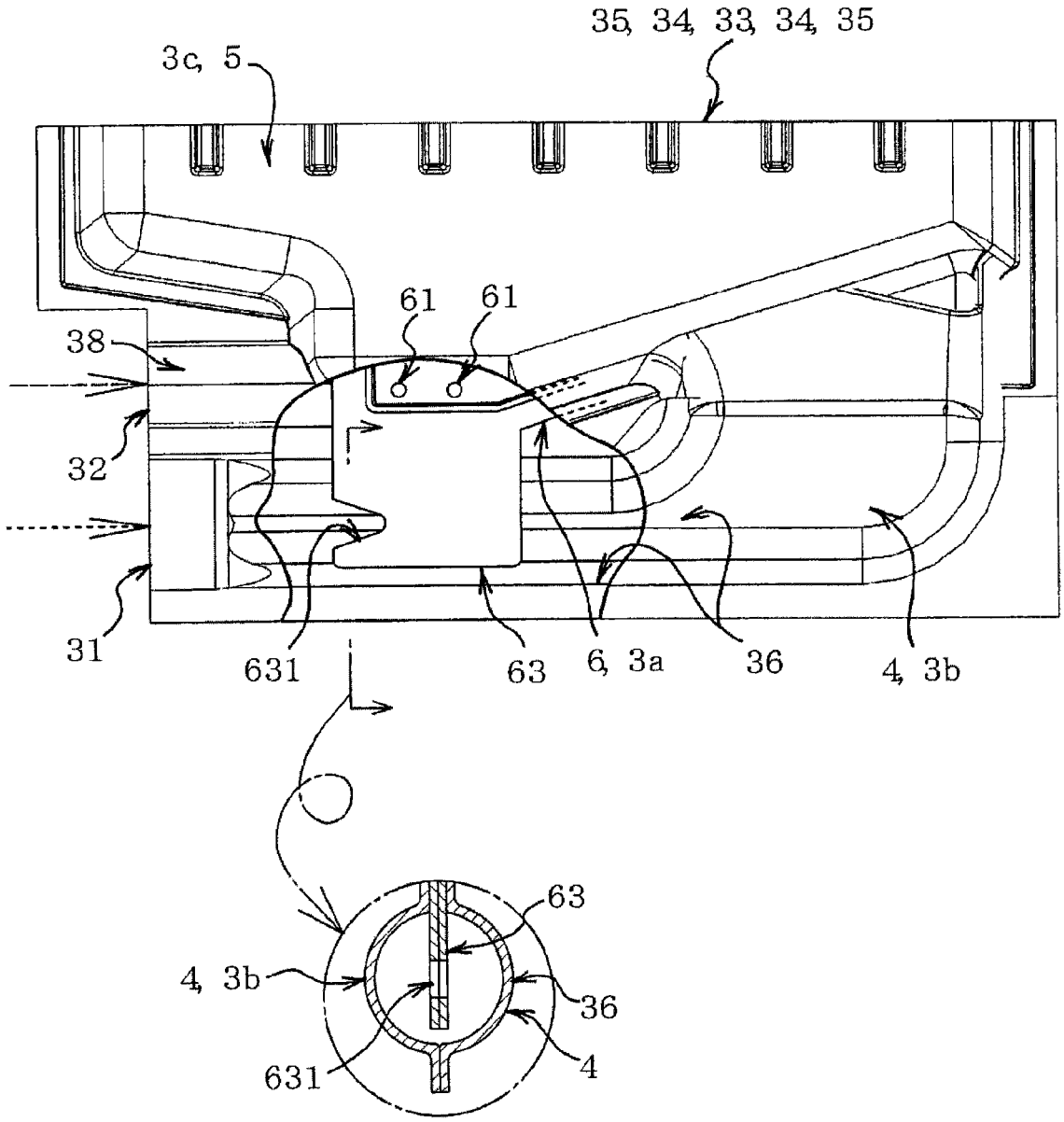
FIG. 14 is a front view of a rich-lean combustion burner according to a third embodiment of the present invention, with its part cut away.

FIG. 14 is a partially cut-away front view of a rich-lean combustion burner 3 according to a third embodiment of the present invention. The third embodiment intends to increase the degree of mixing in introducing fuel gas and air into the tubular part 36 from the first supply port 31. To sum up, in order to accomplish NOx reduction to a further extent by increasing the air ratio of lean-side mixture supplied to the lean-side flame hole rows 34, 34 of the lean-side burner 3*b* from the tubular part 36, it is required to further ensure the degree of mixing of the lean-side mixture also in order to secure the stability of lean-side flame combustion. Heretofore, with a view to securing the degree of mixing of the lean-side mixture, it is general practice to narrow the lean-side mixture supply channel somewhere therealong. However, if the supply channel is narrowed, this results in increase in pressure loss to cause increase in load against the air distribution fan 24 (see FIG. 1). To cope with this, in the third embodiment, the mixing of lean-side mixture is accelerated while diminishing pressure loss by reduction in passage resistance. In addition, the third embodiment differs from the first and the second embodiments only in that projecting pieces 63, 64 and shape variation parts 631-633, 641 (described hereinafter) are provided. Other configurations are almost the same as the first embodiment and, thus, any overlapping description is omitted and only characteristic features will be described below.

Figure 15:
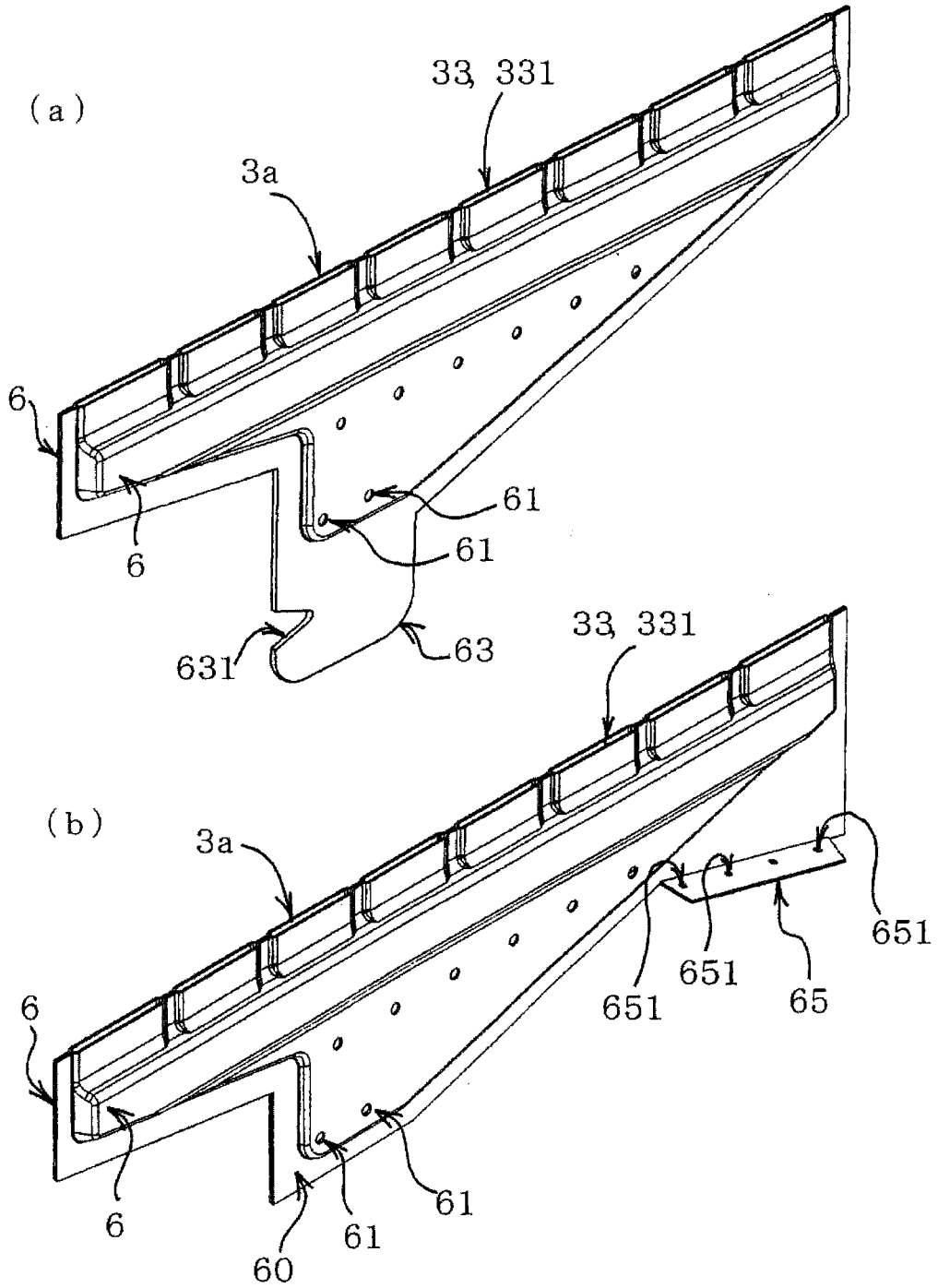
FIG. 15 is comprised of FIG. 15(*a*) and FIG. 15(*b*), wherein FIG. 15(*a*) is a perspective view showing a central rich-side burner part employed in the third embodiment and FIG. 15(*b*) is a perspective view showing a central rich-side burner part employed in a fourth embodiment of the present invention.

In the third embodiment, the lower end part 60 (see FIG. 9) of the central rich-side burner 3*a* arranged in the tubular part 36 is further projected downward, as shown in FIG. 15(*a*), to thereby form a projecting piece 63 capable of flaring into the tubular part 36, and the shape variation part 631 is formed in the projecting piece 63. The projecting piece 63 is arranged at a position that divides the inside of the tubular part 36 in half, and the shape variation part 631 is arranged so as to be situated on an extension of the nozzle center of the gas nozzle 26 (see FIG. 1(*b*)). FIGS. 14 and 15(*a*) show an example of the shape variation part 631 with a laterally facing V-shaped notch. In this case, fuel gas discharged out into the tubular part 36 from the first supply port 31 collides with the shape variation part 631 and the flow of the fuel gas is disturbed, thereby accelerating the mixing of fuel gas with air. Furthermore, since the shape variation part 631 is formed in the projecting piece 63 disposed so as to divide the inside of the tubular part 36 in half, the passage resistance is held low.

Figure 16:
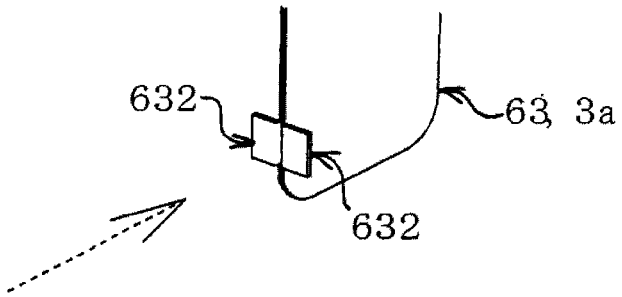
FIG. 16, comprised of FIG. 16(*a*), FIG. 16(*b*) and FIG. 16(*c*), shows another example of a shape variation part formed in the central rich-side burner part of the third embodiment, wherein FIG. 16(*a*) shows an example of a bent shape, FIG. 16(*b*) shows an example of a bulged shape and FIG. 16(*c*) shows an example of a bent shape adapted to save the obtaining of material.
Figure 16:
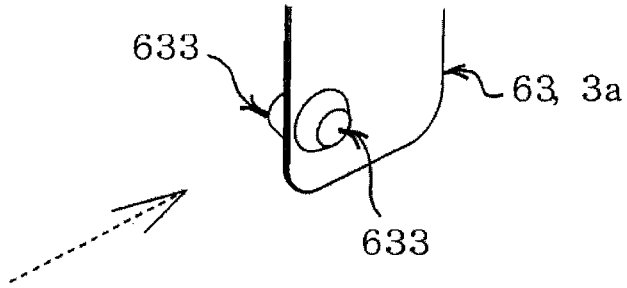
Figure 16:
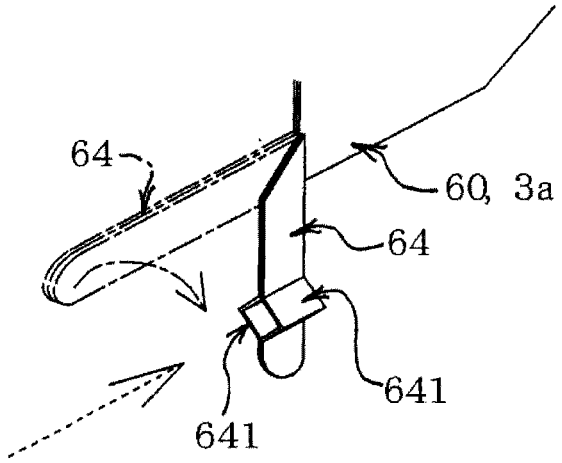

There are other examples of the third embodiment. In one example, there is provided as a shape variation part 632 formed in the projecting piece 63 a collision surface capable of being hit by fuel gas, as shown in FIG. 16(*a*). In another example, there is provided as a shape variation part 633 formed in the projecting piece 63 a bulging part, as shown in FIG. 16(*b*). Alternatively, as shown in FIG. 16(*c*), there is preformed a projecting piece 64 (see alternate long and short dash line in the figure) that is projected not downward but forward from the lower end part 60 of the central rich-side burner 3*a*. The projecting piece 64 is then bent an angle of 90 degrees so as to project downward (see solid line in the figure). And, there may be formed in the projecting piece 64 a shape variation part 641, for example, by bending or the like. In addition, it is not required that the lower ends of the projecting pieces 63, 64 project and lie in the vicinity of the bottom position of the tubular part 36 (see, for example, FIG. 14) so as to divide the inside of the tubular part 36 in half. That is, for example, it suffices if the lower ends of the projecting pieces 63, 64 just project into the tubular part 36 so that the flow of fuel gas collides thereagainst or it suffices if the lower ends of the projecting pieces 63, 64 project in an eccentric direction other than the center of the inside of the tubular part 36.

Fourth Embodiment

Figure 17:
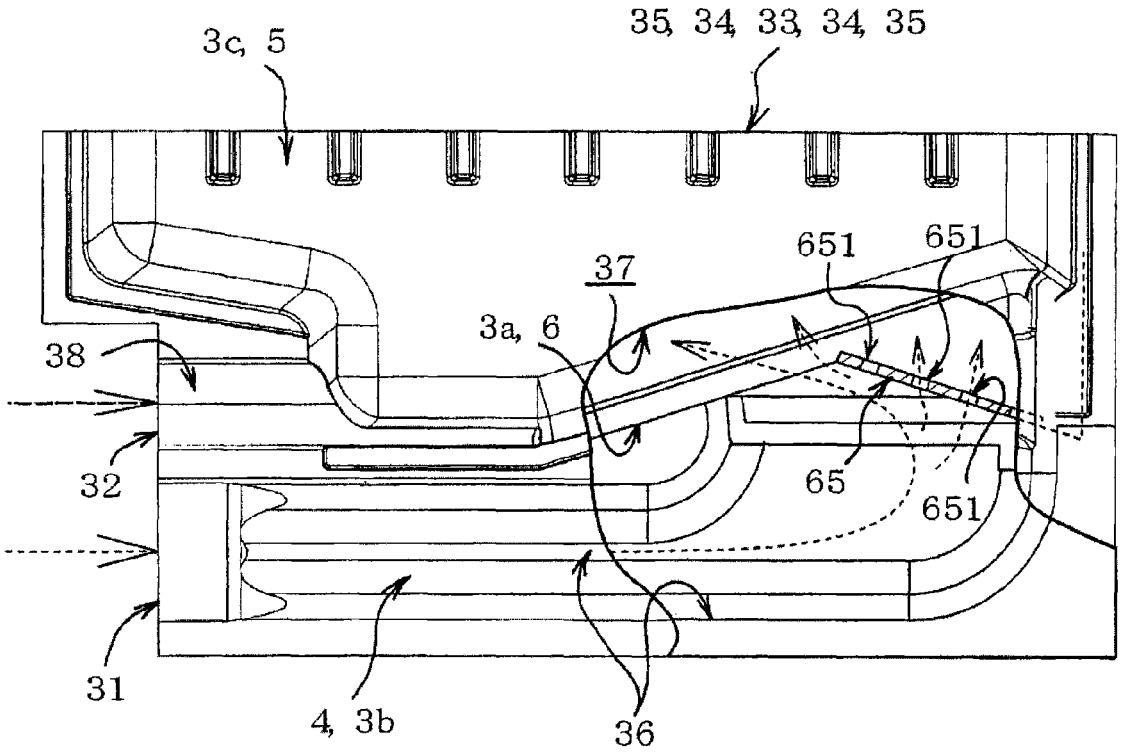
FIG. 17 is a front view of a rich-lean combustion burner according to the fourth embodiment, with a part thereof cut away.
Figure 18:
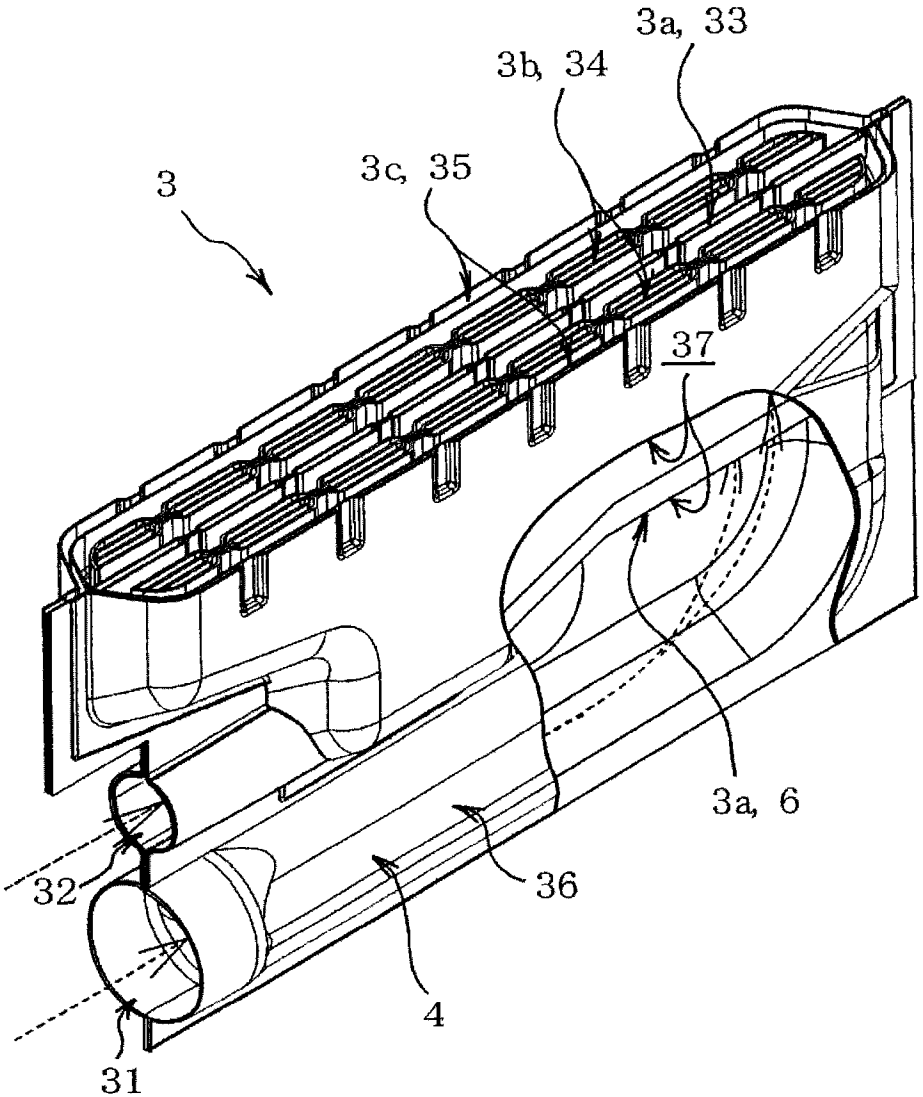
FIG. 18 is a perspective view showing, for the purpose of comparison with the rich-lean combustion burner of the fourth embodiment, a rich-lean combustion burner having no baffle plate as in the fourth embodiment, with a part thereof cut away.

FIG. 17 is a partially cut-away front view of a rich-lean combustion burner 3 according to a fourth embodiment of the present invention. The fourth embodiment is an embodiment in which the flow rate of lean-side mixture, discharged out from the lean-side flame hole rows 34, 34 after being directed from the first supply port 31 on one side to the other side by way of the tubular part 36 and then supplied to the lean-side flame hole rows 34, 34, is equalized throughout the entire longitudinal length. That is, for the case of the fourth embodiment or the like, as exemplarily shown in FIG. 18, the lean-side mixture, mixed after introduction from the first supply port 31 situated on one side, reaches through the tubular part 36 the other side at which the lean-side mixture changes direction to now flow upward. Then, the lean-side mixture reaches the lean-side flame hole row 34 by way of the inner space 37 and is discharged out therefrom. However, for the case shown in FIG. 18, even if the lean-side mixture changes direction to flow upward at the position on the other side of the tubular part 36, this will not equalize the discharge flow rate of lean-side mixture in the range throughout the entire longitudinal length but will cause same to tend to vary. To cope with this, measures have been taken. That is, there is interposed a portion to narrow down the supply passage, which portion is situated at an upper side position (at a position on the downstream side) behind where the flow direction is changed, but the interposition of such a narrowing portion resultingly requires that the entire burner be increased in vertical height for a corresponding amount. Accordingly, the fourth embodiment is to equalize the discharging flow rate of lean-side mixture in the range throughout the entire longitudinal length of the lean-side flame hole rows 34, 34 without increasing the entire burner in vertical height. In addition, the difference from the first embodiment and so on is only the particulars of the baffle plate 65 (hereinafter described). Other configurations are almost the same as the first embodiment and, thus, any overlapping description is omitted and only characteristic features will be described below.

In the fourth embodiment, the baffle plate 65 is disposed so as to provide, at an upper side position on the other side, relative to the longitudinal direction, of the tubular part 36, shielding to thereby provide blocking with respect to the inner space 37 and so as to extend obliquely, whereby the direction of the flow of lean-side mixture is conversion-guided so as to be directed not upward, but obliquely upward towards the one side relative to the longitudinal direction. Therefore, it becomes possible to positively supply the lean-side mixture to the range of lean-side flame holes situated on the longitudinal one side opposite to the longitudinal other side of the tubular part 36. Besides, the baffle plate 65 of such a type (see also FIG. 15(*b*)) is also formed by cutting and raising the lower end edge of the central rich-side burner 3*a*, whereby it becomes possible to reduce the number of component parts as well as to achieve omission in mount operation. Furthermore, by forming through-holes 651, 651, . . . having a predetermined diameter in the baffle plate 65, it becomes possible that the supply of lean-side mixture is provided also to the inner space 37 situated in the upper region from the longitudinal other side of the tubular part, whereby the flow of lean-side mixture to the lean-side flame hole rows 34, 34 can be more finely regulated.

What is claimed is:

1. A rich-lean combustion burner comprising two rows of lean-side flame holes disposed so as to sandwich, therebetween and from both lateral sides, one row of central rich-side flame holes disposed so as to longitudinally extend in a central position and two rows of outer rich-side flame holes disposed so as to sandwich, therebetween and from outside, both said two rows of lean-side flame holes, wherein a flow of a rich-side mixture introduced into a single rich-side mixture introduction channel is diverged from said single rich-side mixture introduction channel, whereby said rich-side mixture is distributed to said one row of central rich-side flame holes and to said two rows of outer rich-side flame holes, wherein a first supply channel for supply of said rich-side mixture to said one row of central rich-side flame holes, a second supply channel and a third supply channel for individual supply of said rich-side mixture to each of said two rows of outer rich-side flame holes and said rich-side mixture introduction channel are partitioned from one another, wherein a first portion of a formation member for partition formation of said first supply channel is disposed so as to project into said rich-side mixture introduction channel and wherein a pair of facially-opposing first communication holes is formed in said projecting first portion of said formation member facilitating fluid communication of the rich-side mixture from said rich-side mixture introduction channel and into the first supply channel, and wherein a second communication hole and a third communication hole are formed in respective ones of second and third portions of the formation member so that the second communication hole facilitates fluid communication of the rich-side mixture from said rich-side mixture introduction channel into the second supply channel and the third communication hole facilitates fluid communication of the rich-side mixture from the rich-side mixture introduction channel into the third supply channel.

2. The rich-lean combustion burner as set forth in claim 1, wherein said rich-side mixture introduction channel longitudinally extends, with its downstream end closed, wherein said first supply channel is partition-formed between one pair of walls situated facing each other in lateral direction in said projecting first portion of said formation member, with a predetermined lateral inner width spaced therebetween, and wherein said pair of first communication holes is formed in each of said wall pair and wherein both said first communication holes are formed so as to pass through in alignment with each other in lateral direction.

3. The rich-lean combustion burner as set forth in claim 2, wherein each of said first communication holes is formed so as to have an opening the size of which is equal to or in excess of said inner width between said wall pair at a location where each of said first communication holes is formed.

4. The rich-lean combustion burner as set forth in claim 2, wherein each of said first communication holes is formed at said projecting first portion on a position situated nearer to an upstream of said rich-side mixture introduction channel so as to leave an inner space on a side nearer to the closed end of said rich-side mixture introduction channel than a location where each of said first communication holes is formed.

5. The rich-lean combustion burner as set forth in claim 1, wherein each of said first communication holes is formed at an upper part of said projecting first portion in said rich-side mixture introduction channel.

6. The rich-lean combustion burner as set forth in claim 1, wherein each of said first communication holes is formed in the shape of a long hole which is elongated in a direction in which said rich-side mixture introduction channel extends.

7. The rich-lean combustion burner as set forth in claim 1, wherein a size of opening of each of said first, said second and said third communication holes is set so that either a size of opening of said central rich-side flame holes becomes smaller than a size of opening of said outer rich-side flame holes, or an amount of said rich-side mixture to be supplied to said central rich-side flame holes becomes less than an amount of said rich-side mixture to be supplied to said outer rich-side flame holes.

8. The rich-lean combustion burner as set forth in claim 1, wherein it is arranged that a flow of a lean-side mixture introduced into a single lean-side mixture introduction channel is diverged into two lean-side mixture supply channels for individual supply of said lean-side mixture to each of said two rows of lean-side flame holes, and wherein said formation member for partition formation of said first supply channel is placed so as to divide a downstream space of said lean-side mixture introduction channel in half for partition formation of said two lean-side mixture supply channels.

9. A combustion apparatus that comprises a rich-lean combustion burner as set forth in any one of claims 1-8.

* * * * *